US005758471A

United States Patent [19]

Denley et al.

[11] Patent Number: 5,758,471

[45] Date of Patent: Jun. 2, 1998

[54] LOAD BUILDING AND WRAPPING APPARATUS

[75] Inventors: Robert B. Denley; Patrick R. Lancaster, III, both of Louisville, Ky.; Steven E. DeGrasse, New Albany, Ind.

[73] Assignee: Lantech, Inc., Louisville, Ky.

[21] Appl. No.: 743,177

[22] Filed: Nov. 5, 1996

[51] Int. Cl.[6] ..... B65B 53/00; B65B 35/30

[52] U.S. Cl. ..... 53/399; 53/441; 53/447; 53/556; 53/587; 53/540

[58] Field of Search ..... 53/399, 441, 447, 53/556, 587, 537, 540, 543

[56] References Cited

U.S. PATENT DOCUMENTS

| | | | |
|---|---|---|---|
| 3,495,374 | 2/1970 | Ebbers et al. | 53/447 X |
| 3,876,057 | 4/1975 | Jones | 53/447 X |
| 3,885,678 | 5/1975 | Borg et al. . | |
| 4,132,318 | 1/1979 | Wang et al. . | |
| 4,593,517 | 6/1986 | Mattila | 53/441 |
| 4,666,050 | 5/1987 | Krieger et al. | 212/211 |
| 4,704,060 | 11/1987 | Winski et al. | 414/792.6 |
| 4,934,123 | 6/1990 | Salzsauler | 53/399 |
| 4,938,008 | 7/1990 | Salzsauler | 53/556 |
| 4,993,209 | 2/1991 | Haloila | 53/399 |
| 4,995,224 | 2/1991 | Yourgalite et al. | 53/540 |
| 5,005,335 | 4/1991 | Yourgalite et al. | 53/399 |
| 5,046,303 | 9/1991 | Becicka et al. | 53/540 |
| 5,107,657 | 4/1992 | Diehl et al. | 53/141 |
| 5,240,139 | 8/1993 | Chirnomas | 221/2 |
| 5,311,725 | 5/1994 | Martin et al. | 53/556 |
| 5,315,809 | 5/1994 | Gordon et al. | 53/556 |
| 5,336,042 | 8/1994 | Winski et al. | 414/789.5 |
| 5,372,472 | 12/1994 | Winski et al. | 414/786 |
| 5,390,476 | 2/1995 | Morantz | 53/556 |
| 5,404,691 | 4/1995 | Scherer | 53/399 |
| 5,423,163 | 6/1995 | Wendt | 53/556 |
| 5,445,493 | 8/1995 | Yourgalite et al. | 414/791.6 |

OTHER PUBLICATIONS

Newtec Inc., Pack Expo Booth N-165, Low-level case palletizer.

*Primary Examiner*—Linda Johnson

*Attorney, Agent, or Firm*—Finnegan, Henderson, Farabow, Garrett & Dunner, L.L.P.

[57] ABSTRACT

A method of building and wrapping a load including infeeding load units to an infeed area of a layer building area at an infeed level below a desired height of the load, repeatedly building load layers in a layer building area from load units incoming from the infeed area at the infeed level, repeatedly transporting the load layers from the layer building area to a load building and wrapping area to sequentially build a load of layers to the desired height of the load in the load building and wrapping area from layers built in the layer building area, wrapping the load of layers in the load building and wrapping area while building at least one interim layer in the layer building area from load units, outputting the wrapped load from the load building area, and sequentially transporting the interim layer and at least one other layer built in the layer building area from the layer building area to the load building and wrapping area to sequentially form a load of layers in the load building and wrapping area.

20 Claims, 35 Drawing Sheets

LOAD BUILDING AND WRAPPING APPARATUS

BACKGROUND OF THE INVENTION

The present invention relates to building and wrapping a load, and more particularly to stretch wrapping a load.

Commercial products are often packaged together in a load and subsequently wrapped for transportation from a manufacturing facility. Machines that build a load of layers of products onto a pallet are generally known as palletizers. A conventional palletizer is fed product from an infeed conveyor and accumulates a single layer of product onto a plate. Once the layer is accumulated, the layer is deposited onto the pallet. This process is repeated until the desired number of layers are positioned on the pallet to build a load. Machines which then wrap the sides of a load with a web of stretch material to cover and contain the load are generally known as stretch wrapping machines. Upon completion of building a load of product on a pallet, the pallet is removed from the palletizer and transported to the stretch wrapper by a fork truck, an automated guided vehicle, a pallet car, a conveyor belt, or other transport mechanism.

SUMMARY OF THE INVENTION

An object of the invention is to provide a load building and wrapping apparatus that efficiently builds loads of layers of product and stretch wraps completed loads. Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises an apparatus and method of building and wrapping a load that includes infeeding load units to an infeed area of a layer building area at an infeed level below a desired height of the load. Load layers are repeatedly built in a layer building area from load units incoming from the infeed area at the infeed level. The load layers are repeatedly transported from the layer building area to a load building and wrapping area to sequentially build a load of layers to the desired height of the load in the load building and wrapping area from layers built in the layer building area. The load of layers is wrapped in the load building and wrapping area while building at least one interim layer in the layer building area from load units. The wrapped load is outputted from the load building area, and the interim layer and at least one other layer built in the layer building area are sequentially transported from the layer building area to the load building and wrapping area to sequentially form a load of layers in the load building and wrapping area.

According to another aspect, the invention comprises an apparatus and method of building and wrapping a load that includes repeatedly building load layers from load units in a layer building area horizontally displaced from a load building and wrapping area. The load layers are repeatedly transported from the layer building area to the load building and wrapping area to sequentially form a load of layers in the load building and wrapping area from layers built in the layer building area. The load of layers is wrapped in the load building and wrapping area while building at least one interim layer in the layer building area from load units. The load is supported with a support at a fixed height while building and wrapping the load. The wrapped load is outputted from the load building area, and the interim layer and at least one other layer built in the layer building area are sequentially transported from the layer building area to the load building and wrapping area to sequentially form a load of layers in the load building and wrapping area.

According to a further aspect, the invention comprises an apparatus for building and wrapping a load including a packaging material dispenser for dispensing packaging material, means for providing relative rotation between the packaging material dispenser and the load in a load building and wrapping area and wrapping the packaging material around the load, a layer building palletizer for building a load layer from load units in a layer building area horizontally displaced from the load building and wrapping area, and a layer transporter for transporting the load layer from the layer building area to the load building and wrapping area.

According to another aspect, the invention comprises an apparatus and method of building and stretch wrapping loads of layers of load units that includes repeatedly building a layer of load units of a first load onto a first plate of a palletizer and depositing the layer of load units onto a stretch wrapping apparatus until the first load of layers is built to a desired height, rotating the first load relative to a web dispenser that dispenses and stretches a web to wrap the web around the first load, and building a layer of load units of a second load on a second plate of the palletizer while the first load is being wrapped.

According to yet another aspect, the invention comprises an apparatus and method of building and stretch wrapping loads of layers of load units that includes rotating a first load of load units on a stretch wrapping apparatus relative to a web dispenser that dispenses and stretches a web to wrap the web around the first load, repeatedly building a layer of load units of a second load onto a first plate of a palletizer and depositing the layer of load units onto a second plate of the palletizer to form a stack of layers of the second load while the first load is being wrapped and until the first load is fully wrapped, removing the wrapped first load from the stretch wrapping apparatus, and depositing the stack of layers of the second load onto the stretch wrapping apparatus.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention.

DESCRIPTION OF THE PREFERRED EMBODIMENTS

Figure 1:
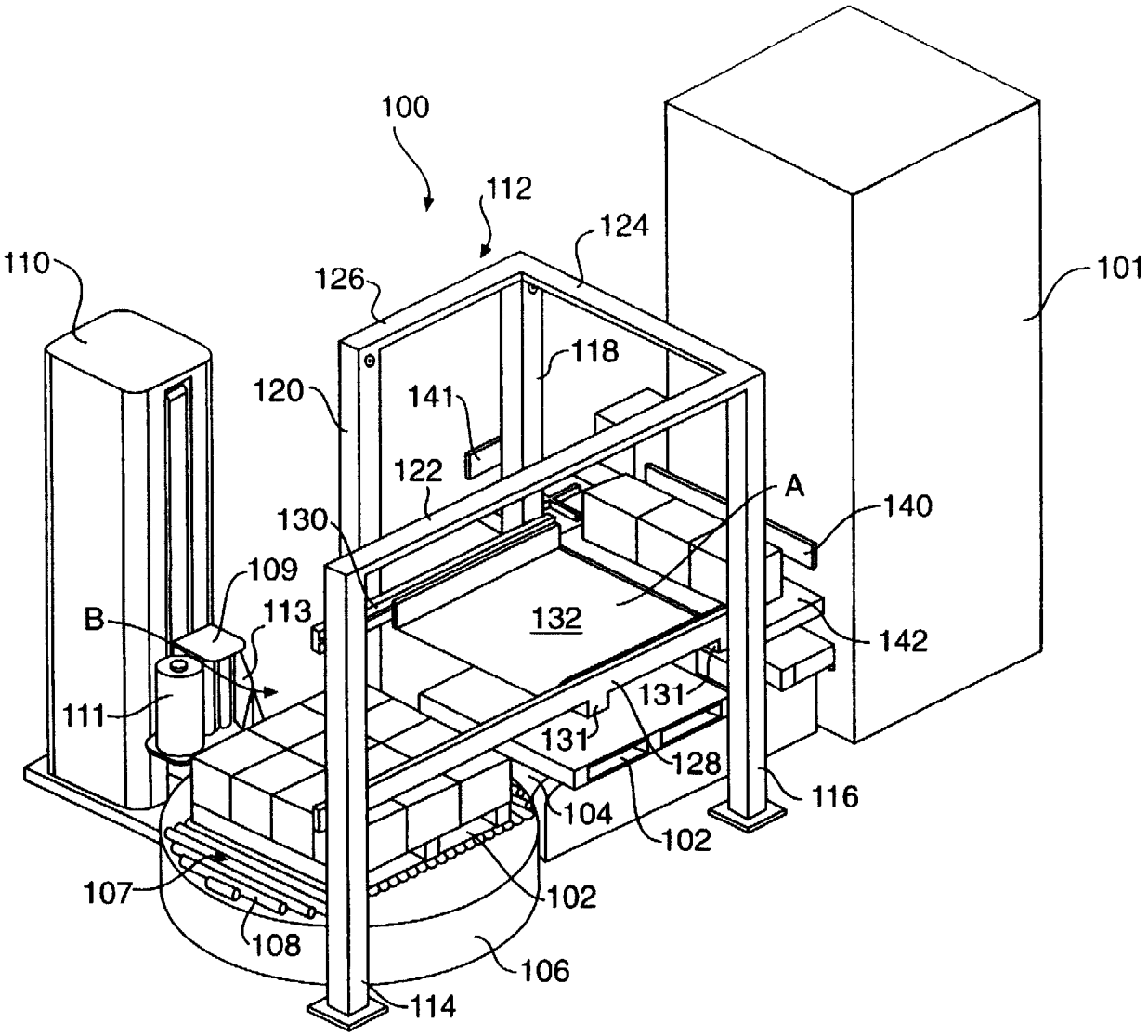
FIG. 1 is a perspective view of a first embodiment of a load building and wrapping apparatus according to the present invention.

Reference will now be made in detail to the present preferred embodiments of the invention, examples of which are illustrated in the accompanying drawings. Wherever possible, the same reference numbers will be used throughout the drawings to refer to the same or like parts.

The present invention relates to a load building and wrapping apparatus that simultaneously builds one or more layers of products (i.e. load units) while stretch wrapping a load of layers. The building of a load generally entails two steps: layer building and load building. Layer building is the accumulation of load units from an infeed conveyor onto a plate of the palletizer. Load building is the stacking of the prepared layers to a desired height for subsequent wrapping. The stretch wrapping generally entails rotating the load relative to a stretch wrap packaging material dispensing apparatus to wrap the stretch wrap around the sides of the load. Packaging of the load may also require additional steps, such as placing cornerboards on the load to protect corners of the load or add column strength, banding the wrapped load, or covering the top of the load with a top sheet of film or other materials.

Three embodiments of a load building and wrapping apparatus are described below. In the first, an open frame palletizer having a single stripper plate prepares a single layer of load units while an integrated stretch wrapper wraps a full load. The second embodiment includes an open frame palletizer having two layer building plates. As in the first embodiment, a layer of product is prepared while the stretch wrapper wraps a full load. In the second embodiment, however, two plates are used to prepare the layer. The third embodiment also incorporates a palletizer having two layer building plates. In the third embodiment, a plurality of layers of load units may be prepared while the load is being wrapped. In each of these three embodiments, the coordinated motion of various layer building, load building, and load wrapping components results in an integrated palletizing and stretch wrapping process and apparatus that provides for the efficient preparation of loads of layers of product units and the stretch wrapping of the loads. This invention overcomes the disadvantages of previous palletizers and stretch wrappers by reducing the amount of cycle time wasted while waiting for a load to be wrapped, decreasing floor space required, and overcoming load stabilization problems during transport of the load to the stretch wrapper.

In addition, in the preferred embodiments of the present invention and accordirg to an aspect of the invention, the load units are fed from an infeed area at a level below a desired height of the load to be wrapped. The benefits of a low-level infeed over a high-level infeed are numerous and significant. A low-level infeed provides easier accessability for maintenance and higher visibility should a shut down occur. In addition, a low-level infeed does not require additional flooring, such as a mezzanine, and the associated flooring support. The flooring and support are costly. A low-level infeed is also safer, should products fall off of a conveyor, and results in less damage to such products.

Also in the preferred embodiments of the present invention and according to an aspect of the invention, a stretch wrapping apparatus is used that supports a load of load units at a fixed height during the load building and stretch wrapping steps. In this way, a palletizer according to the present invention can be retrofitted to a conventional low cost stretch wrapping apparatus that supports a load at a fixed height. Such a stretch wrapping apparatus offers significant advantages over one that varies the height of the load during the load building and stretch wrapping steps. A fixed height stretch wrapping apparatus is less complex, resulting in lower cost and maintenance, and saves energy by not having to displace an entire load. The load used on such a stretch wrapping apparatus is also more stable during the load building and stretch wrapping operations.

First Embodiment

The first embodiment of a load building and wrapping apparatus is shown in FIGS. 1–4, and designated generally by reference numeral 100. Apparatus 100 includes a conventional pallet dispenser 101 that dispenses conventional pallets 102 onto a conveyor 104. Conveyor 104 conveys pallets 102 onto a conventional turntable 106. Turntable 106 includes an upper conveying surface 107 having a plurality of rollers 108. Turntable 106 is positioned proximate to a mast 110 of a conventional stretch wrapping apparatus. Mast 110 carries a stretch wrap packaging material dispenser 109 to wrap stretch wrap packaging material 111 around a load assembled onto and rotated by turntable 106.

Apparatus 100 also includes a stripper plate frame 112 having legs 114, 116, 118, and 120, upper cross beams 122, 124, and 126, and guide rails 128 and 130. A stripper plate 132 is mounted on guide rails 128 and 130 by rollers, a telescopic drawer pull arrangement, or other suitable mechanism to permit stripper plate 132 to slide along guide rails 128 and 130 in a horizontal direction from a layer building area A to a load building area B.

Guide rails 128 and 130 are connected by cross beams 131 and are vertically moveable on legs 114, 116, 118 and 120 by motor-driven chain lifts or other suitable elevating mechanisms. This permits vertical displacement of stripper plate 132 so as to place prepared layers of product onto either a pallet 102, a previously deposited layer, or a slip sheet (i.e. cardboard or plastic sheet used for stability during transport) at varying heights on turntable 106, as will be described below.

Figure 64:
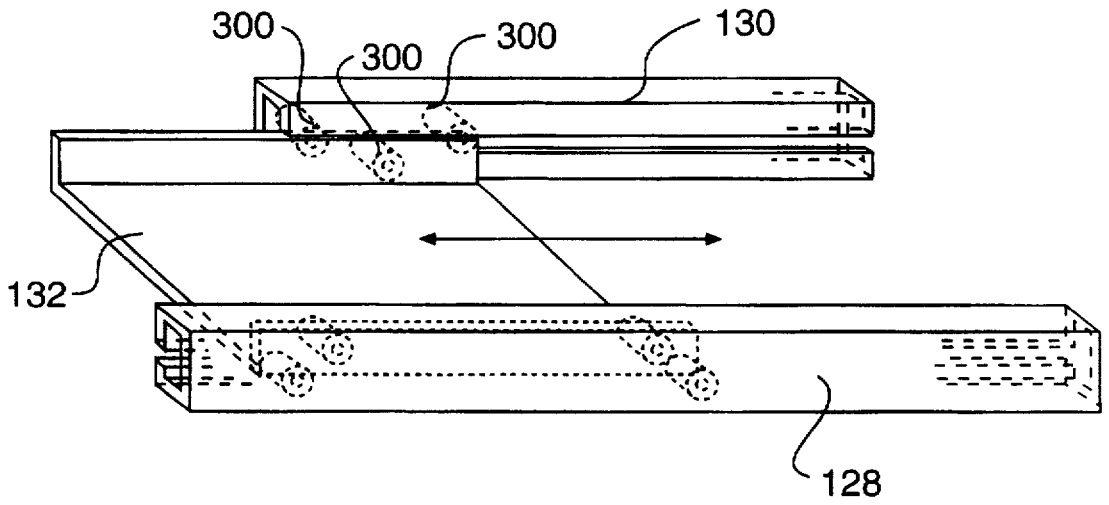
FIG. 64 is a perspective view of one embodiment of a stripper plate and guide rails used in a load building and wrapping apparatus according to the present invention.

When stripper plate 132 is displaced horizontally from layer building area A to load building area B, stripper plate 132 extends from guide rail 130, as shown for example in FIG. 64. FIG. 64 shows a one-corner cantilever relationship between stripper plate 132 and guide rail 130. Stripper plate 132 is cantilevered by rollers 300, or other suitable means, such as cam followers, wheels, slide blocks, etc., that permit slidable movement between stripper plate 132 and guide rail 130. Guide rail 130 extends only the length of layer building area A, while guide rail 128 extends through load building area B, as shown more clearly in FIG. 1, so that stripper plate frame 112, and particularly guide rail 130, do not interfere with the stretch wrapping apparatus during the stretch wrapping operation.

Figure 3:
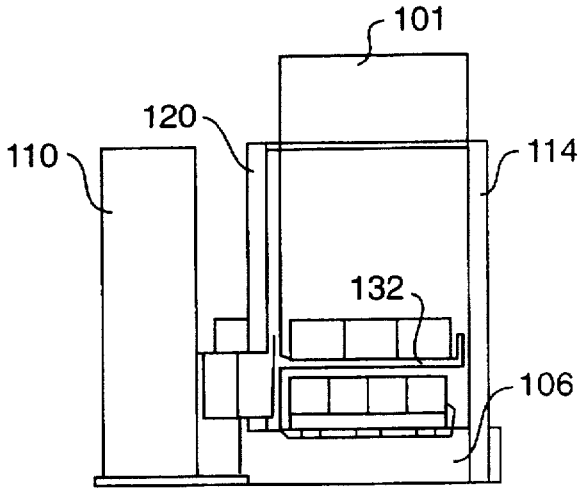
FIG. 3 is a front view of the load building and wrapping apparatus of FIG. 1.
Figure 4:
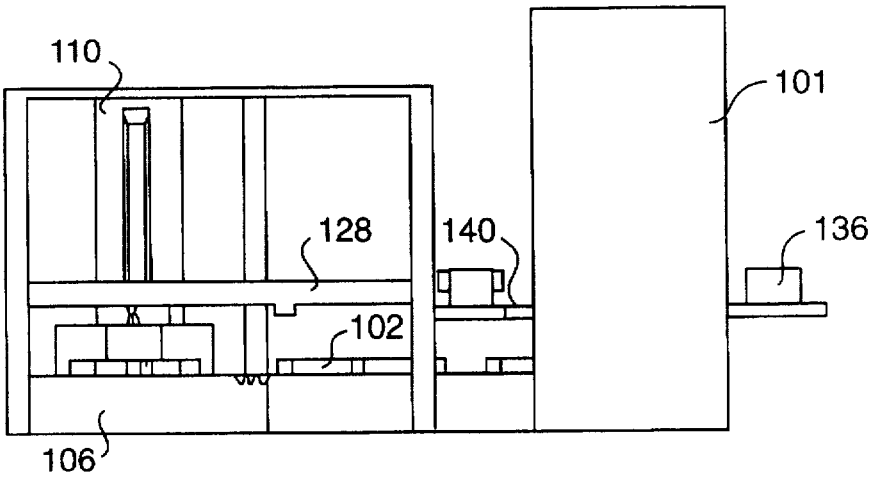
FIG. 4 is a side view of the load building and wrapping apparatus of FIG. 1.
Figure 65:
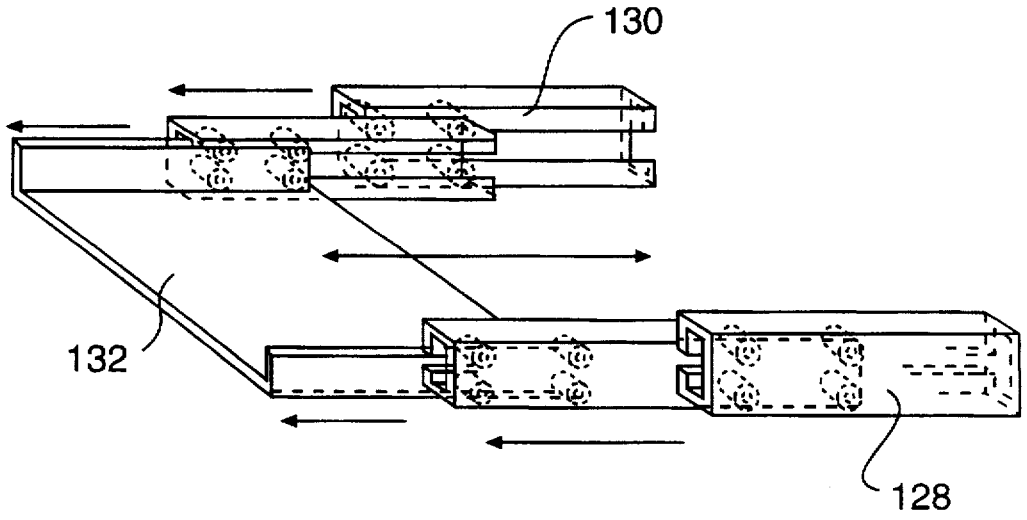
FIG. 65 is a perspective view of another embodiment of a stripper plate and guide rails used in a load building and wrapping apparatus according to the present invention.

As an alternative, guide rail 130 can telescope from a retracted position shown in FIGS. 1 and 3 to an extended position shown in FIG. 65 when stripper plate 132 is displaced horizontally from layer building area A to load building area B. As also shown in FIG. 65, guide rail 128 may also be constructed so as to telescope from a retracted position to an extended position.

Figure 2:
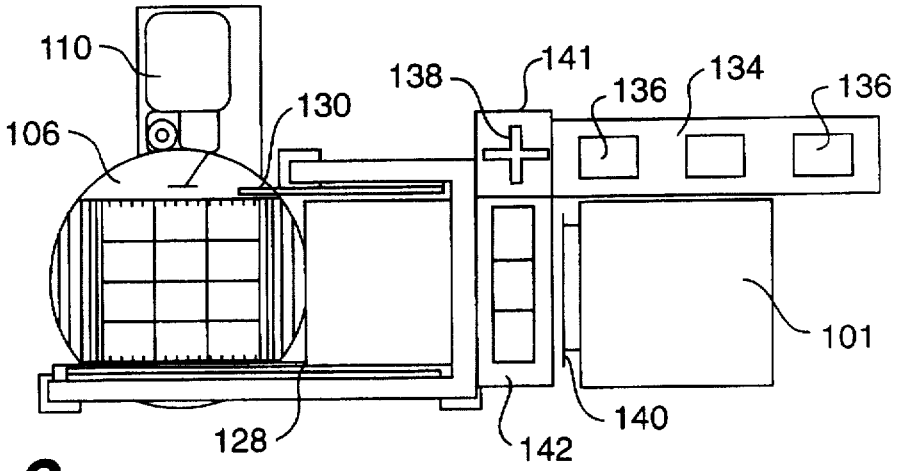
FIG. 2 is a top view of the load building and wrapping apparatus of FIG. 1.

As most clearly shown in FIG. 2, an infeed conveyor 134 conveys load units 136 to a star wheel 138, which may be used to change the orientation of load units 136 by rotating them about a vertical axis. In this way, load units 136 of alternate layers may be oriented at right angles to each other so as to provide a more stable stack of load units, particularly if load units 136 are of an irregular shape. This also can be used to orient load units 136 so as to provide a desired face of load units 136 on the perimeter of the assembled layer.

A first pusher bar 141 pushes load units 136 in a direction transverse to in-feed conveyor 134 onto an accumulating conveyor 142 to form a row of load units 136. Accumulating conveyor 142 is typically made up of a plurality of rollers, a drive belt, or other transport mechanism, and a stop (not shown) to stop the leading load unit from further conveyance, allowing subsequent load units 136 to be driven into the leading load unit. An assembled row of load units 136 is then pushed by a second pusher bar 140 onto stripper plate 132. This process is repeated until a layer of load units is assembled onto stripper plate 132.

Figure 61:
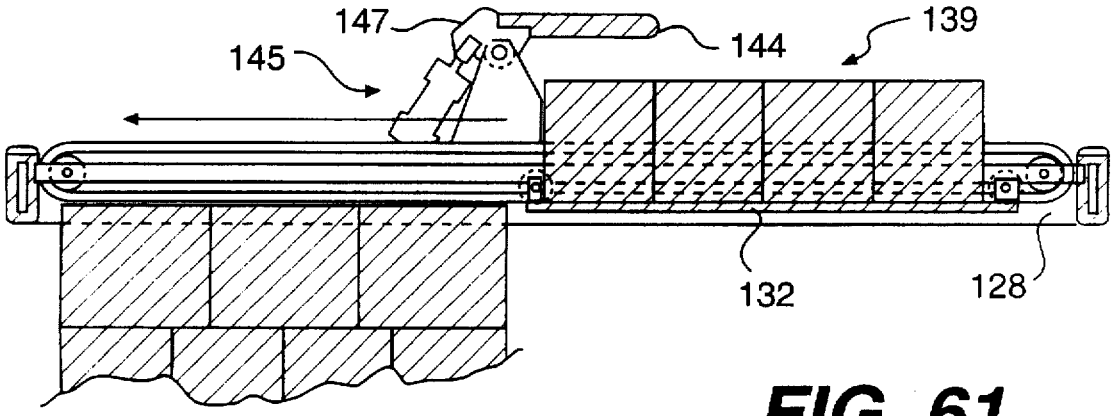
FIGS. 61 to 63 are side views of a stripper plate and stripper bar for use in the load building and wrapping apparatus of FIG. 1.
Figure 62:
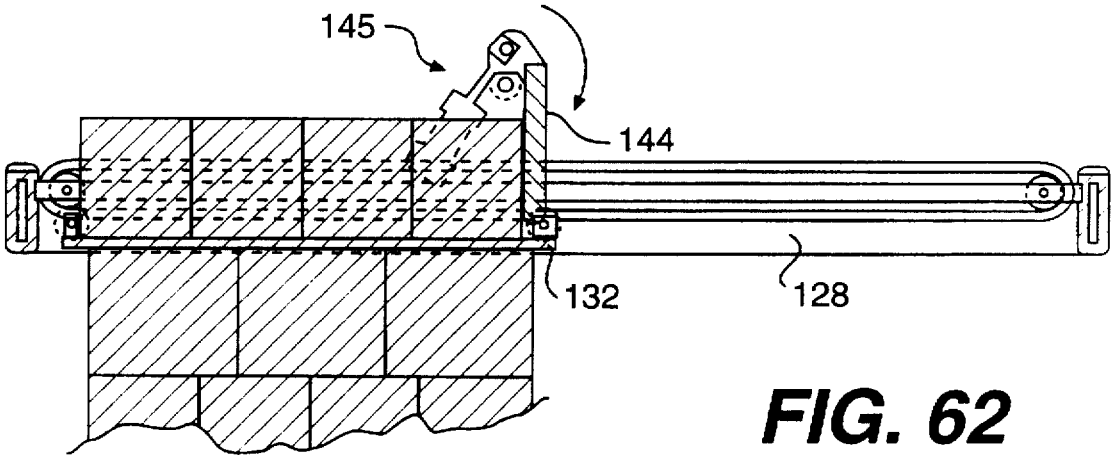
Figure 63:
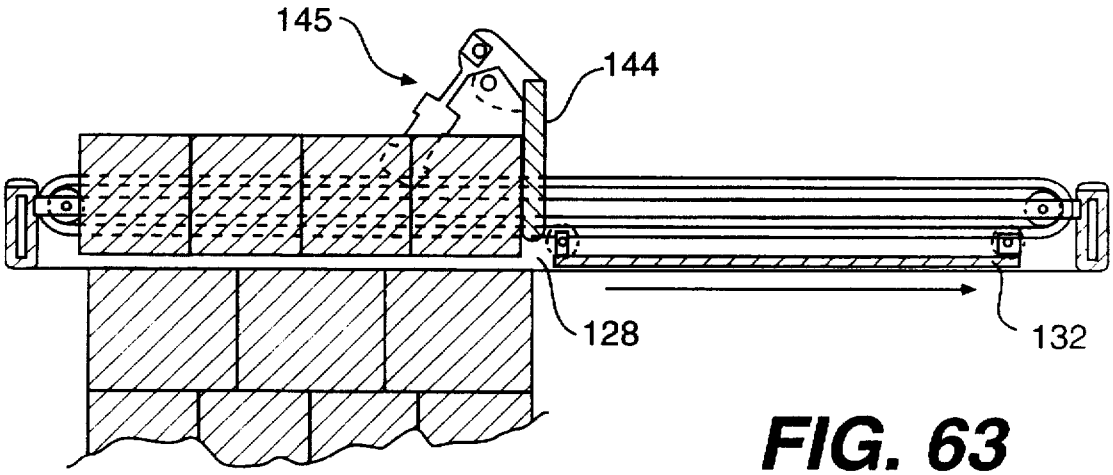

After stripper plate 132 has a complete layer of load units 136, guide rails 128 and 130 are vertically displaced to an appropriate layer depositing position just above pallet 102, the previous deposited layer, or a slipsheet. Then, stripper plate 132 is extended horizontally by a drive mechanism, for example a chain or cylinder drive, from layer building area A to the load building area B. A stripper bar 144, shown in FIGS. 61–63, is then lowered, from an at-rest position shown in FIG. 61 to a displaced position shown in FIGS. 62 and 63, by a mechanical actuator, such as a pneumatic mechanism 145, or other suitable mechanism. Pneumatic mechanism 145 places stripper bar 144 behind the last row of load units 136. Pneumatic mechanism 145 is located on guide rails 128 and 130, and pivotally supports stripper bar 144 at pivot mounts 147. After stripper bar 144 is lowered, stripper plate 132 is then withdrawn (FIG. 63), dropping a layer of load units 136 in place in load building area B. This procedure is repeated until the load reaches its desired height, each time moving guide rails 128 and 130 and stripper plate 132 to the appropriate elevation to position the load layer just above the top of the previously deposited load layer.

After the load is built to the desired height, turntable 106 is rotated and stretch wrap packaging material 111 is dispensed from stretch wrap packaging material dispenser 109 mounted on mast 110. During the wrapping operation, the layer building operation continues in layer building area A. The load is wrapped by the relative rotation of the load with respect to the web 113 being supplied from stretch wrap packaging material dispenser 109. Typically, the bottom layers of the load are wrapped first, and upper layers later as the stretch wrap material dispenser 109 proceeds upward relative to the load. It is to be understood that the stretch wrapping procedure, therefore, may begin prior to the assembly of a full load of layers. Top layers of load units may be stacked intermittently with the previous layers being wrapped to more efficiently build and wrap a load.

Figure 66:
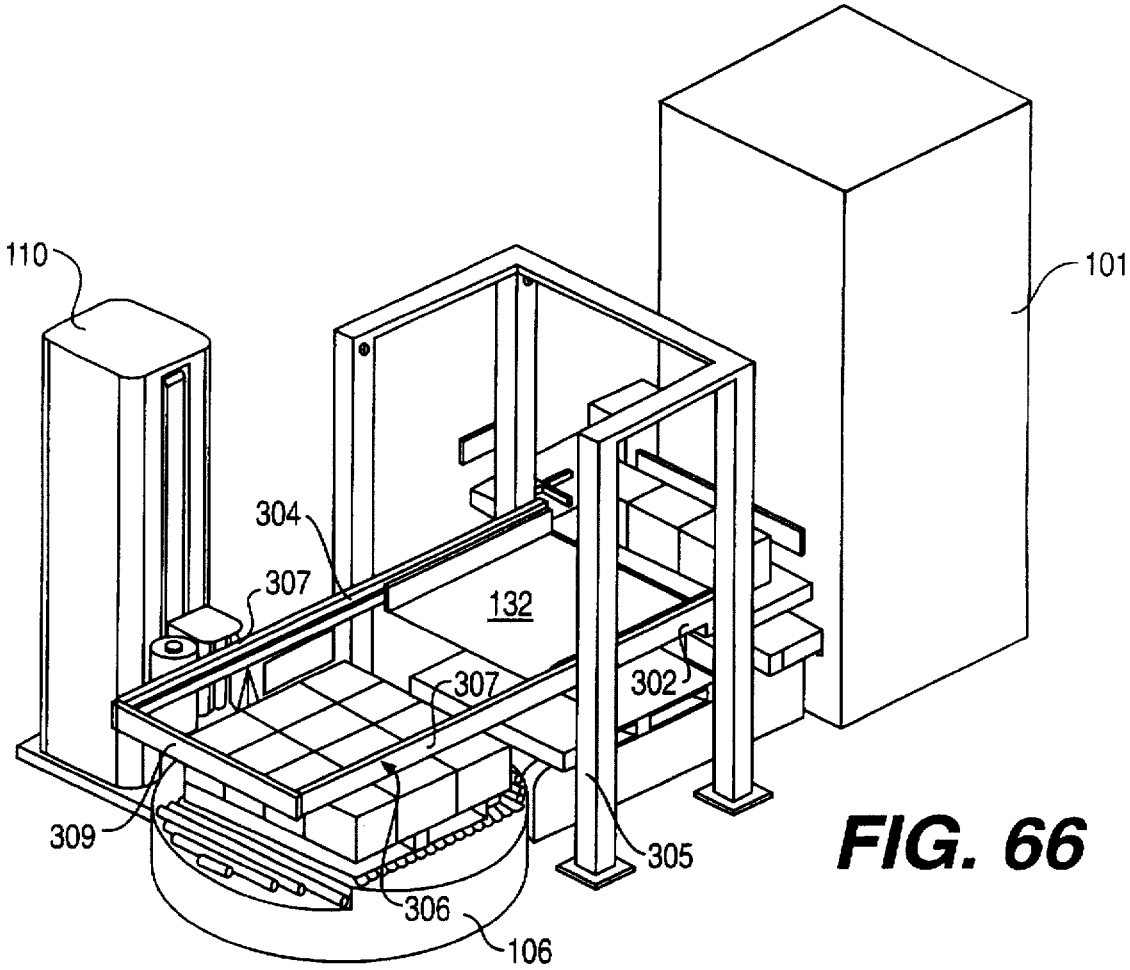
FIG. 66 is a perspective view of another embodiment of a load building and wrapping apparatus according to the present invention.
Figure 67:
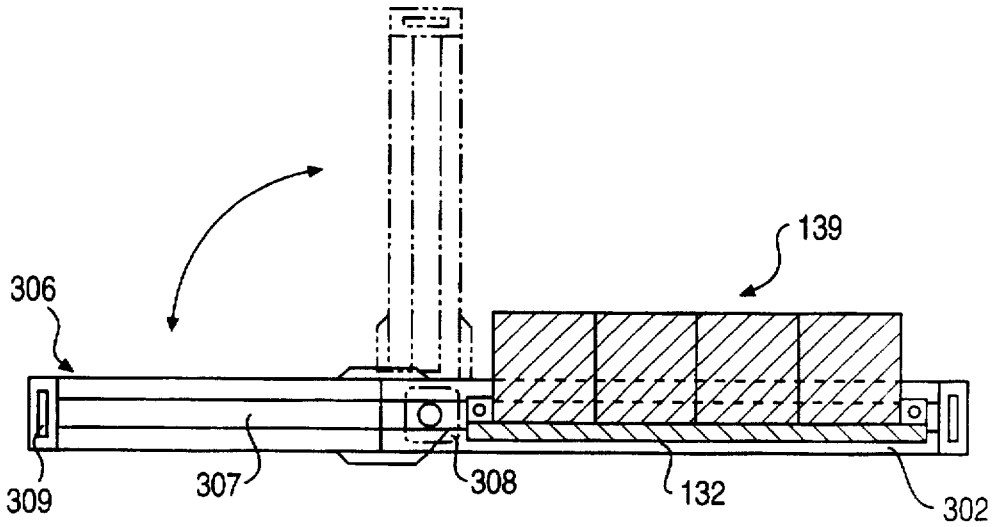
FIG. 67 is a side view of a stripper plate, guide rails, and drawbridge used in the load building and wrapping apparatus of FIG. 66.

FIGS. 66 and 67 show an alternate version of the apparatus described in connection with FIGS. 1–4 and 61–65. The load building and wrapping apparatus shown in FIGS. 66 and 67 is the same in structure and operation as the previously described embodiment except for the structure and operation of the guide rails holding stripper plate 132. Instead of the cantilevered guide rail arrangement shown in FIG. 64 or the telescoping guide rail arrangement shown in FIG. 65, FIGS. 66 and 67 employ a drawbridge arrangement for permitting horizontal displacement of stripper plate 132 form the layer building area to the load building area. In the drawbridge arrangement, stripper plate 132 is held by guide rails 302 and 304. A drawbridge 306, comprised of two guide rails 307 connected by a cross beam 309, connects to guide rails 302 and 304 at pivot points 308. Guide rails 307 have a similar configuration as guide rails 302 and 304. Drawbridge 306 pivots from an up position to a down position, as shown in FIG. 67. When stripper plate 132 has a complete layer 139 of load units 136, guide rails 302 and 304 are vertically displaced to an appropriate layer depositing position, as described earlier. Then, drawbridge 306 is lowered to the down position. Drawbridge 306 then receives stripper plate 132 into the load building area via guide rails 307. Stripper plate 132 is withdrawn from under layer 139, leaving layer 139 in place in the load building area, as also described earlier. Drawbridge 306 is then raised to the up position. As in the earlier described embodiments, this drawbridge arrangement prevents the stripper plate frame, and particularly guide rails 302 and 304, from interfering with the stretch wrapping apparatus during the stretch wrapping operation.

Figure 68:
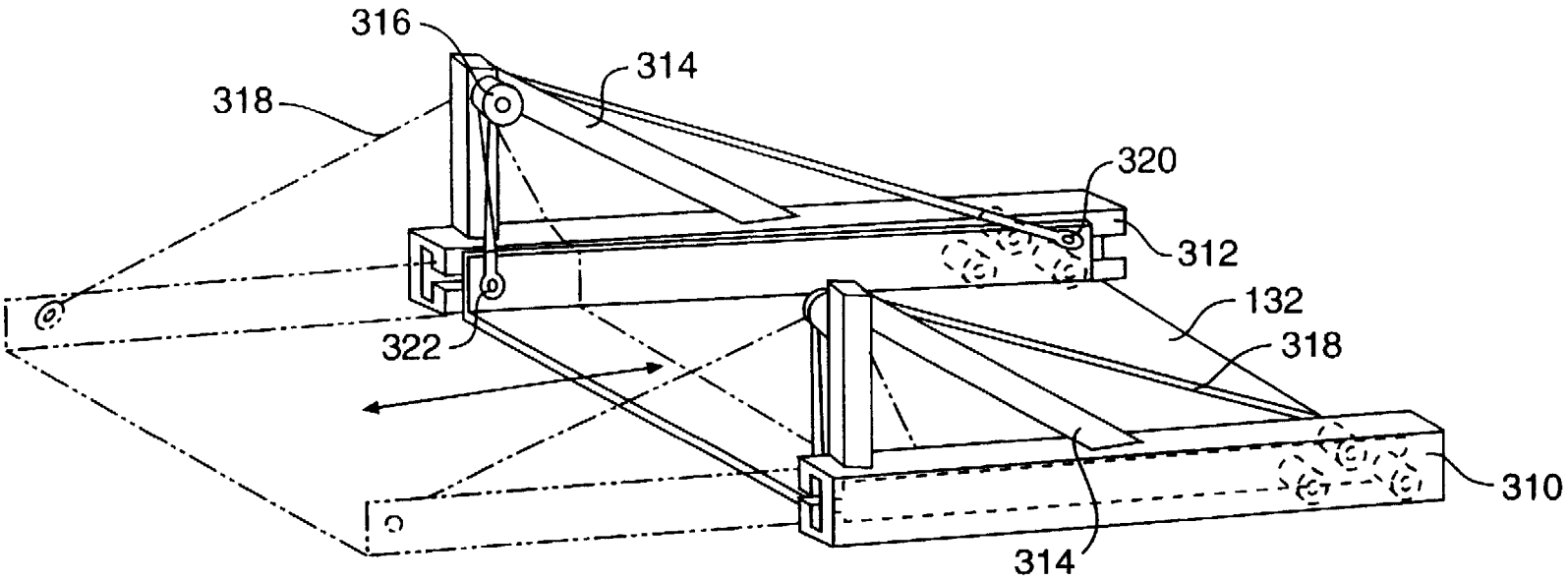
FIG. 68 is a perspective view of another embodiment of a stripper plate and guide rails for use in a load building and wrapping apparatus according to the present invention.

As a further alternative of the cantilevered, telescopic, and drawbridge guide rail arrangements, FIG. 68 shows a pulley guide rail arrangement having guide rails 310 and 312 of a length similar to the length of guide rail 130 in FIG. 1 (i.e., the length of the layer building area). Guide rails 310 and 312 include pulley mounts 314 at a top portion thereof. A pulley 316 is mounted to each pulley mount 314. A flexible means 318, such as a cable, a belt, a chain, or other similar means, connects to the ends of each side of slider plate 132 at swiveling connectors 320 and 322. When stripper plate 132 is displaced along guide rails 310 and 312 from the layer building area to the load building area, cable 318 travels along pulleys 316. Once again, as in previous embodiments, this pulley arrangement prevents the stripper plate frame, and particularly guide rails 310 and 312, from interfering with the stretch wrapping apparatus during the stretch wrapping operation.

Second Embodiment

The second embodiment of a load building and wrapping apparatus according to the present invention is shown and described in connection with FIGS. 5–24. In these Figures, the same reference numerals refer to the same or like parts from FIGS. 1–4. The apparatus shown in FIGS. 5–24 utilizes a conventional pallet dispenser and a conventional stretch wrapper and turntable as described in the first embodiment. The second embodiment differs from the first embodiment in the configuration and components of the stripper plate frame that prepares a layer of load units and moves the prepared layer onto a pallet on the turntable.

Figure 5:
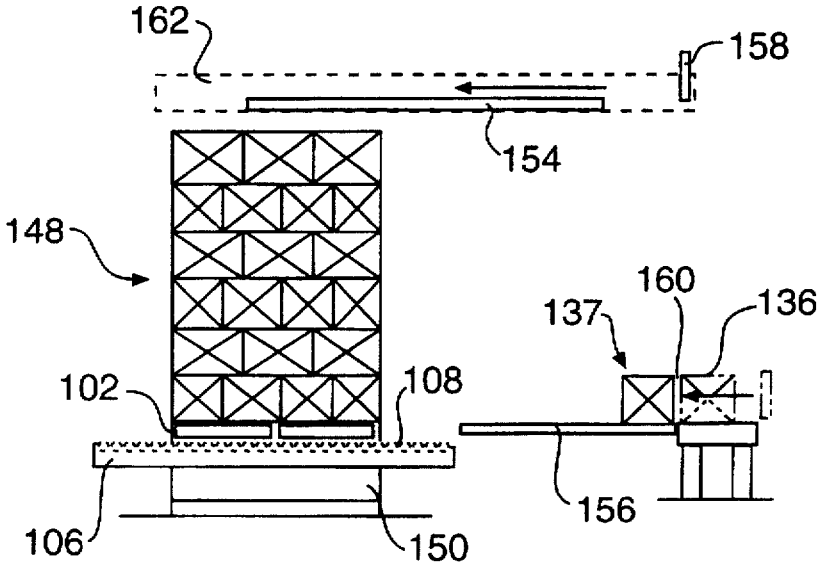
FIGS. 5 to 24 are side views of a second embodiment of a load building and wrapping apparatus according to the present invention, indicating the sequence of operations thereof.

FIG. 5 shows a completed load 148 resting on a pallet 102 on turntable 106. Turntable 106 is placed upon a platform 150 and includes a plurality of conveying rollers 108 for receiving a pallet 102 from the palletizer and for moving a wrapped load off of turntable 106.

The second embodiment of the load building and wrapping apparatus includes two plates and two pusher bars. A stripper plate 154 is positioned on guide rails 162 and corresponds to a first pusher bar 158. Guide rails 162 are vertically moveable by a suitable elevating mechanism (not shown), similar to guide rails 128 and 130 in the first embodiment. A dead plate 156 corresponds to a second pusher bar 160. As will be described, layers 139 of load units 136 are prepared on plates 154 and 156 and transferred to pallet 102 by stripper plate 154 to form a completed load 148. Second pusher bar 160 is used solely to push rows 137 of load units 136 onto dead plate 156. First pusher bar 158 is used both to push rows 137 of load units 136 from dead plate 156 onto stripper plate 154 and also to unload a completed layer 139 of load units 136 from stripper plate 154 onto pallet 102.

Figure 6:
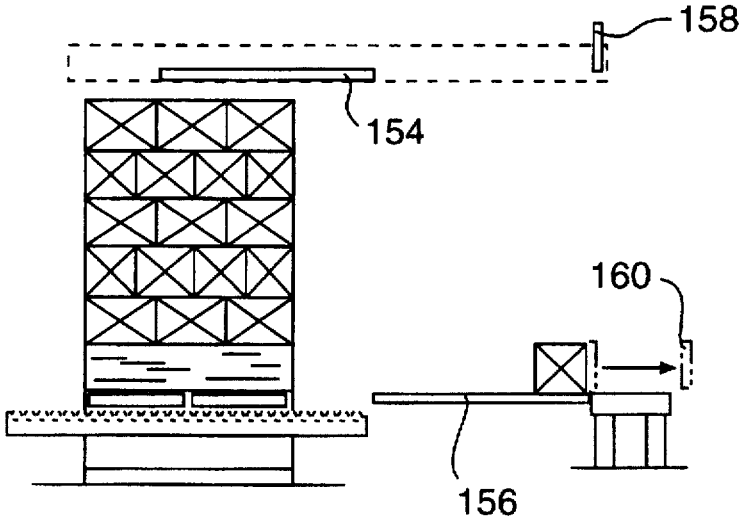
Figure 7:
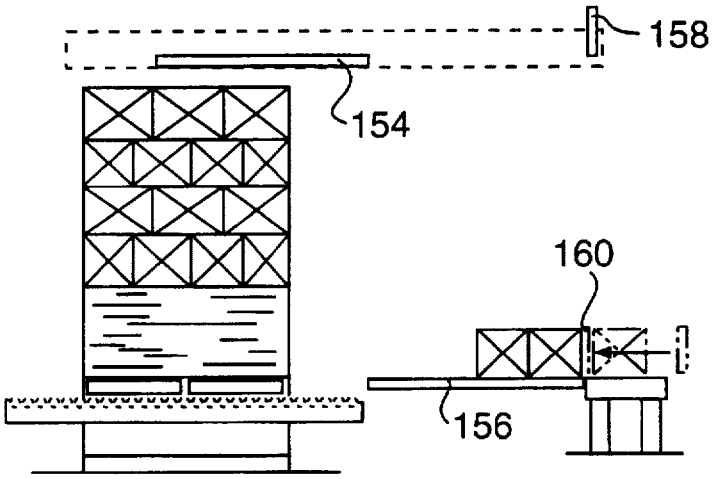
Figure 8:
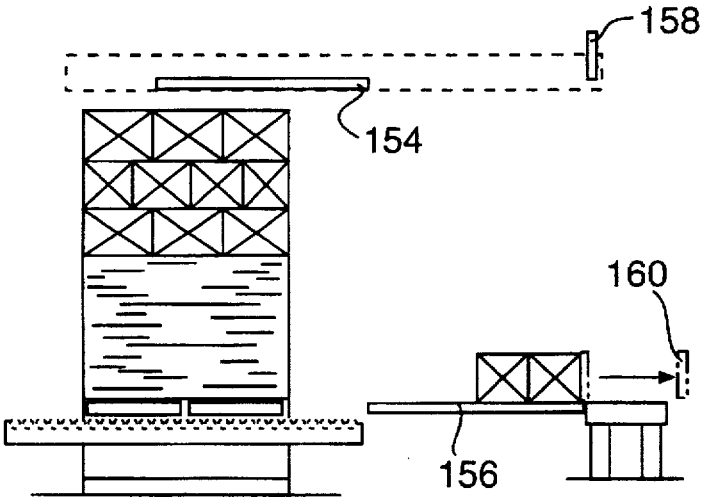
Figure 9:
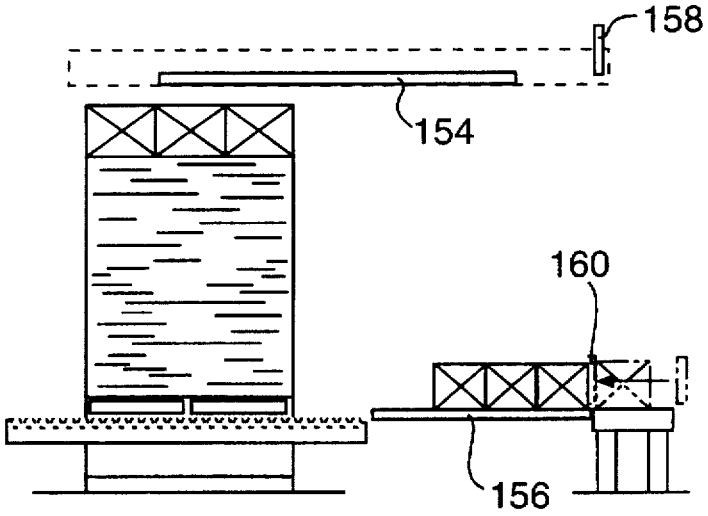
Figure 10:
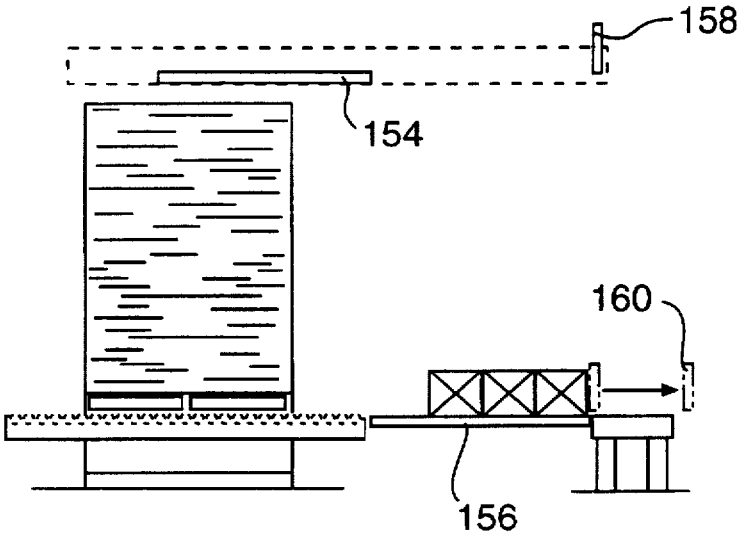
Figure 11:
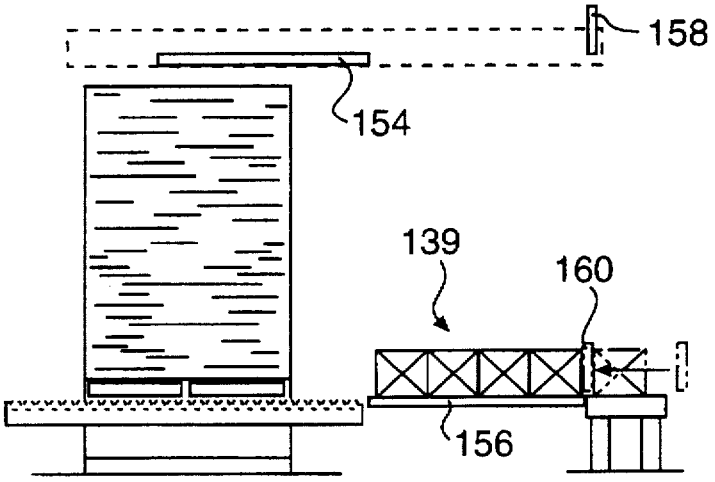
Figure 12:
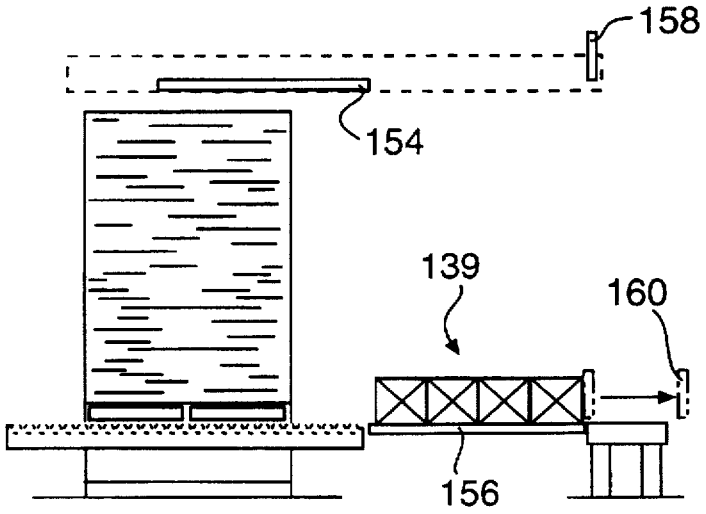
Figure 13:
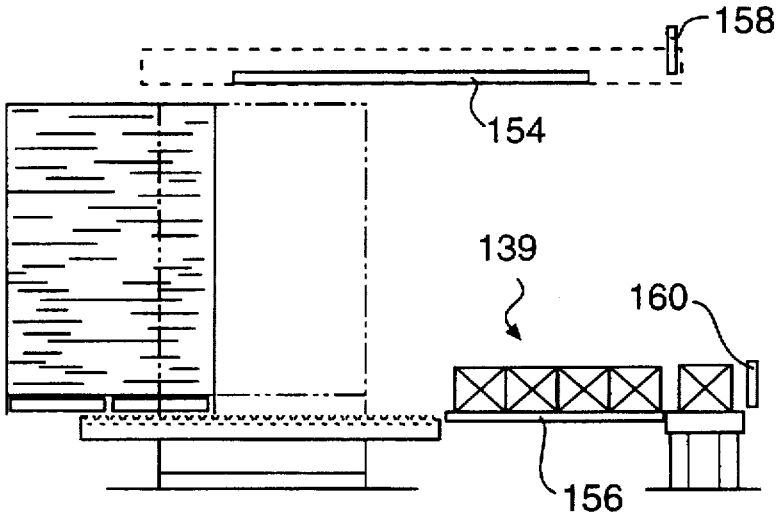

The operation of this second embodiment will now be described in connection with FIGS. 5–24. As shown in FIG. 5, a completed, unwrapped load 148 of layers of load units 136 is positioned on turntable 106. As load 148 is stretch wrapped, stripper plate 154 and first pusher bar 158 rest at a position above load 148 so as to not interfere with any of the wrapping function. Stripper plate 154 and guide rails 162 serve no layer building function at this time, but may be used to perform a function, such as holding the load down during rotation, placing a top cap, or retrieving a slip sheet, etc., that a secondary apparatus would otherwise perform during the wrapping process. As also shown in FIG. 5, once a completed load 148 is positioned on pallet 102 and ready for wrapping, incoming load units 136 on an accumulating conveyor 142 are pushed onto dead plate 156 by second pusher bar 160. FIG. 6 shows the beginning of the stretch wrapping of load 148. At the same time, second pusher bar 160 reciprocates between a retracted position (shown in FIGS. 6 and 8, for example) and an extended position (shown in FIGS. 5 and 7, for example) so as to receive load units 136 and push rows 137 of load units 136 onto dead plate 156. This reciprocal motion of second pusher bar 160 continues in FIGS. 7–12 until a full layer 139 of load units 136 has been assembled onto dead plate 156 from rows 137 of load units 136, and load 148 is completely wrapped by the stretch wrapper, as shown in FIG. 12. The fully wrapped load 148 is then conveyed off of turntable 106 by rollers 108, as shown in FIG. 13, or by other means such as a drag chain or belt, or load 148 is picked up by an operator.

Figure 14:
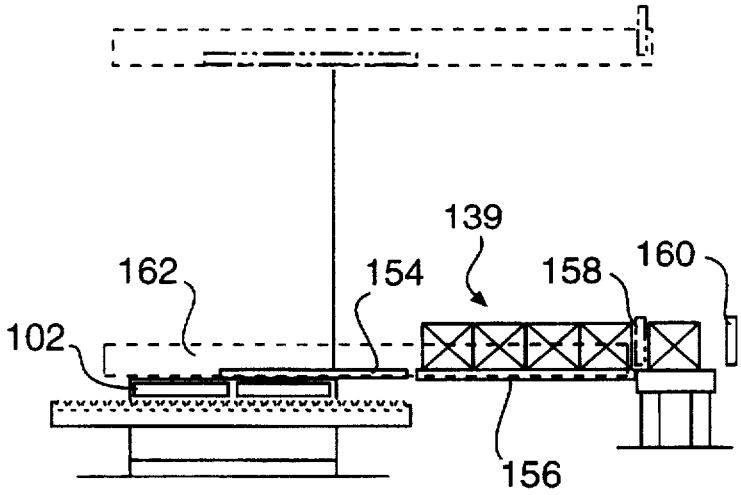
Figure 15:
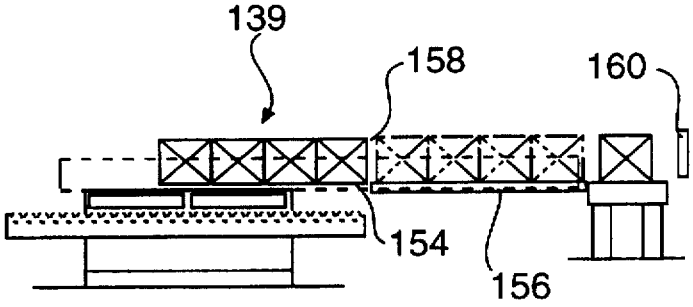
Figure 16:
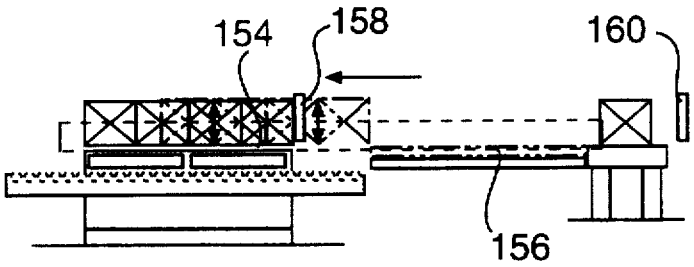

After removal of the wrapped load 148, stripper plate 154 is used to first transfer the assembled layer 139 of load units 136 onto pallet 102 or a slip sheet (not shown), and then to assemble a new load 148, as will be described in connection with FIGS. 14–24. First, as shown in FIG. 14, stripper plate 154 mounted in guide rails 162 is lowered by mechanical means, such as a chain, to the same vertical position as dead plate 156 and a horizontal position that abuts dead plate 156. First pusher bar 158 then pushes layer 139 of load units 136 off of dead plate 156 and onto stripper plate 154, as shown in FIG. 15. This layer 139 of load units 136 is the layer that was prepared during the stretch wrapping of the previous full load 148. Stripper plate 154 then moves horizontally towards a position above pallet 102. At this point, dead plate 156 moves slightly downward by a mechanical means, such as a cam, air cylinder, air bags, screw jacks, etc., as shown in FIG. 16, and will not be employed again until a full load 148 has been assembled and the stretch wrapping operation begins.

Figure 17:
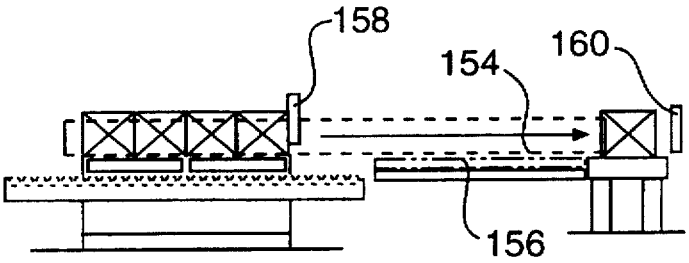
Figure 18:
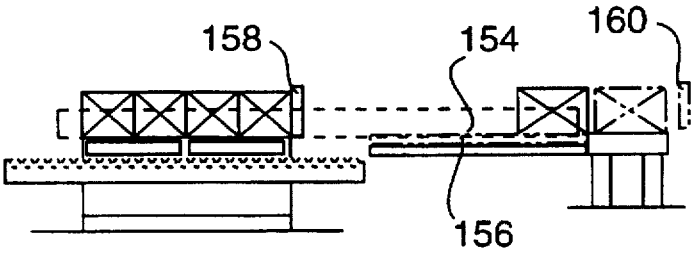
Figure 19:
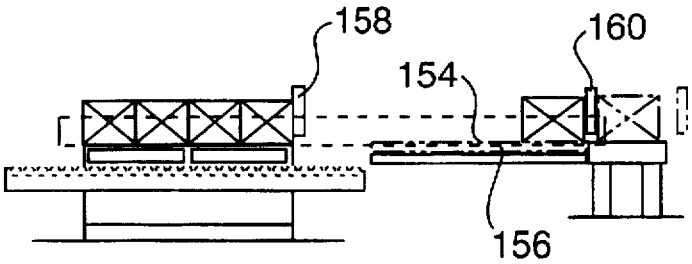
Figure 20:
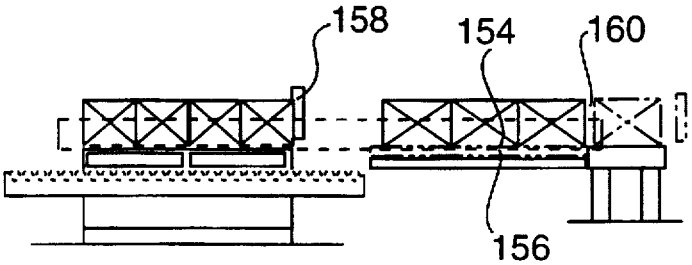

Next, as shown in FIG. 17, stripper plate 154 moves horizontally along guide rails 162 from underneath the layer of load units 136 to a position just above the lowered dead plate 156. First pusher bar 158 remains in place during the horizontal movement of stripper plate 154, preventing the layer of load units 136 from moving with stripper plate 154, thus dropping the layer of load units 136 upon pallet 102 or a slip sheet (not shown).

Stripper plate 154 is now in position to receive incoming load units 136 from the in-feed conveyor. Second pusher bar 160 reciprocates from its retracted position to its extended position to load incoming load units 136 onto stripper plate 154 to form a second layer of load units 136. This second layer includes load units 136 that have an orientation 90 degrees from the orientation of load units of the first layer. This orientation is provided in a similar fashion and for similar reasons as described earlier in connection with the first embodiment.

Figure 21:
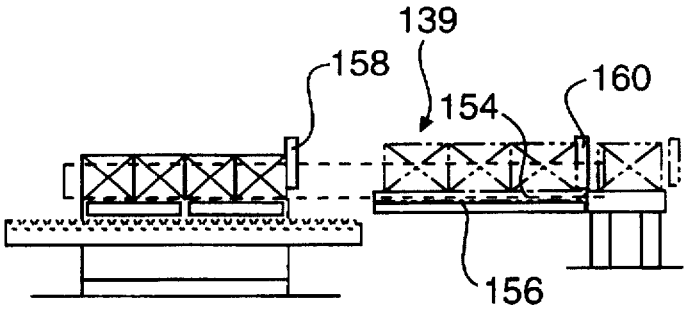
Figure 22:
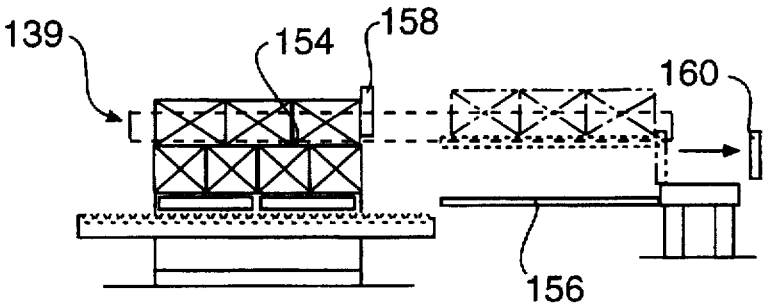
Figure 23:
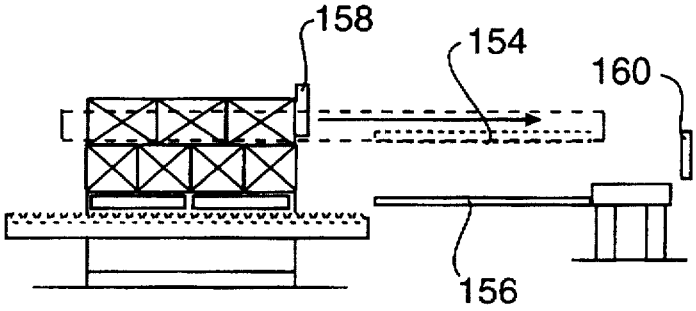
Figure 24:
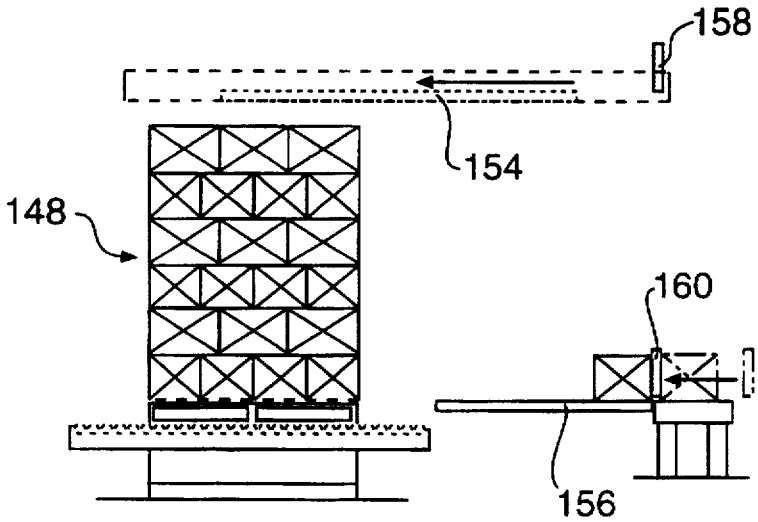

Once a layer 139 of load units 136 has been assembled onto stripper plate 154, as shown in FIG. 21, stripper plate 154 is horizontally displaced to a position slightly above the first layer of load units 136. This positioning is shown in FIG. 22. First pusher bar 158 then holds the layer 139 of load units 136 in place while stripper plate 154 is moved horizontally from underneath the layer, as shown in FIG. 23. This process is repeated until a load 148 of layers of load units 136 has reached a desired height for subsequent stretch wrapping, as shown in FIG. 24. At this point, stripper plate 154 and first pusher bar 158 rest above load 148, and the entire procedure described in connection with FIGS. 5–24 is repeated.

This second embodiment of a load building and wrapping apparatus has the benefit of preparing a layer of load units while wrapping a completed load. In addition, the preparation of this layer of units begins without requiring the stripper plate to be repositioned proximate the infeed conveyor. The preparation of this layer takes place on a plate immediately after the full load 148 is assembled, saving the time needed for the stripper plate to displace vertically towards the conveyor. In addition, the position of dead plate 156 allows guide rails 162 to remain above load 148 and the wrapping process, allowing supporting legs and cross beams to straddle turntable 106, and eliminating the need for a mechanism to cantilever stripper plate 154, as discussed with respect to the previous embodiment.

As also discussed with respect to the previous embodiment, it is to be understood that the stretch wrapping procedure may begin prior to the assembly of a full load. Top layers of load units may be stacked at the same time as the bottom layers are wrapped to more efficiently build and wrap a load.

Third Embodiment

The third embodiment of a load building and wrapping apparatus according to the present invention is shown and described FIGS. 25–60 and FIG. 69. This third embodiment enables a plurality of layers of load units 136 to be prepared and stacked while a load 148 is being stretch wrapped. As will be described, this is performed by the coordinated movement of various components of the device, providing for an extremely efficient method of assembling and stretch wrapping a load.

Figure 69:
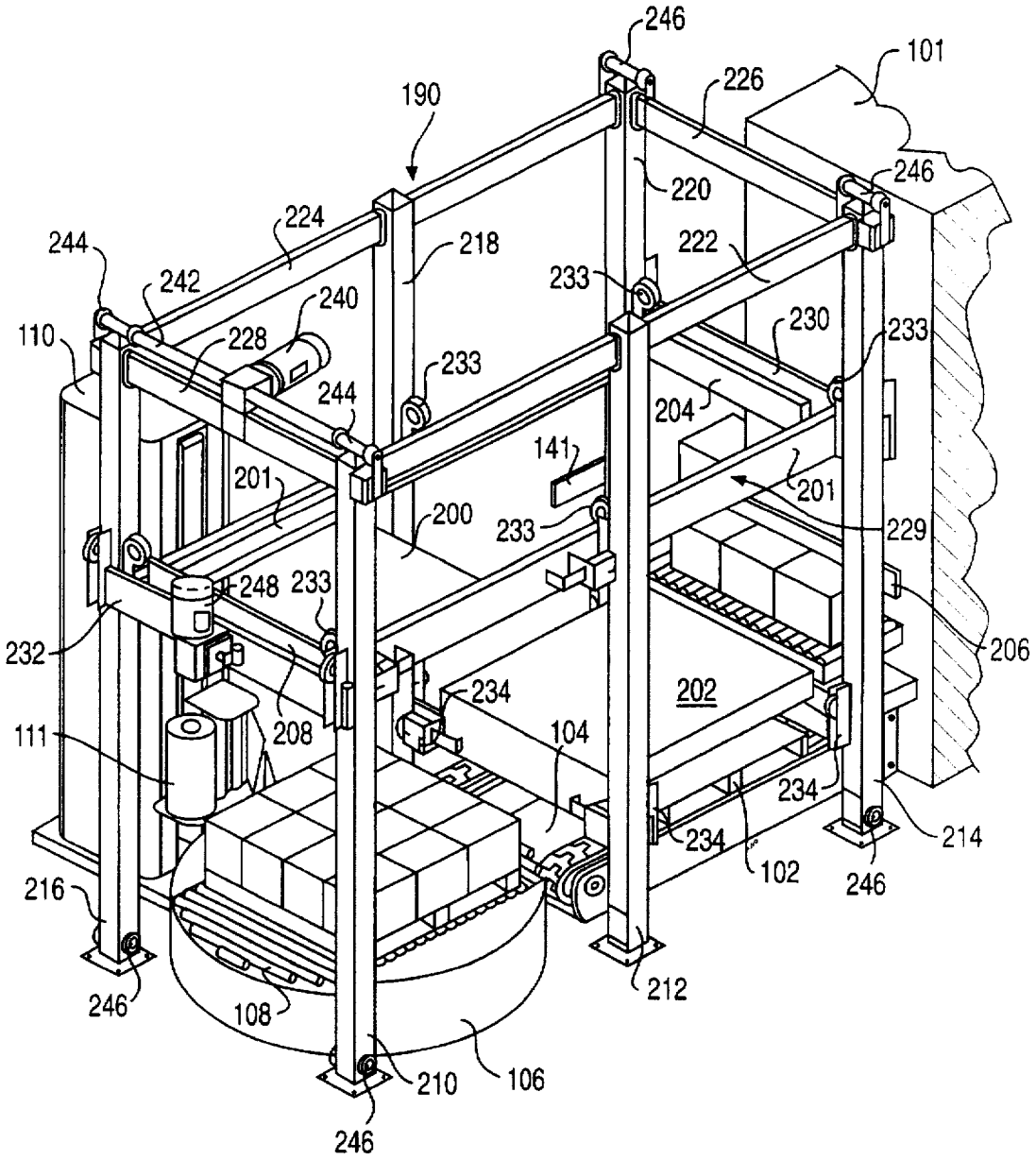
FIG. 69 is a perspective view of the load building and wrapping apparatus of FIGS. 25–60.

FIG. 69 shows the construction of the load building and wrapping apparatus according to this third embodiment. This embodiment uses a stretch wrapping apparatus and pallet dispenser as shown and described in the previously described embodiments, and differs from the previous embodiments in the structure and operation of the main frame 190 that builds layers of load units and deposits layers of load units onto the turntable of the stretch wrapping apparatus. The structure of the load building and wrapping apparatus will now be described prior to describing the operation of the apparatus.

Frame 190 includes legs 210, 212, 214, 216, 218, and 220, upper side beams 222 and 224, and upper cross beams 226 and 228. Frame 190 further includes a stripper plate guide frame 229 having guide rails 201 supporting a stripper plate 200, and cross beams 230 and 232 connected to guide rails 201. Guide rails 201 and cross beams 230 and 232 connect to each leg 210, 212, 214, 216, 218, and 220 via caster assemblies 233 which permit vertical displacement of guide frame 229 along these legs. A pusher bar 204 and a stripper bar 208 are located at opposite ends of guide frame 229, as shown in FIG. 69.

Frame 190 further includes an elevator assembly having an elevator plate 202 connected to each leg 212, 214, 218, and 220 via caster assemblies 234. Caster assemblies 234 permit vertical displacement of elevator plate 202 along these legs.

A stripper plate guide frame lift motor 240 is attached to cross beam 228 for lifting stripper plate guide frame 229. Motor 240 drives a shaft 242 that connects with and drives sprockets 244. Connector chains (not shown) connect sprockets 244 with sprockets 246 at the bottom of legs 210 and 216 and at the top and bottom of legs 214 and 220. The connection of all of these sprockets 244 and 246 by the connector chains is done in such a way so that the rotation of shaft 242 evenly lifts stripper plate guide frame 229.

A similar mechanism for lifting elevator plate 202 may be used. This lifting mechanism (not shown) can be connected to either stripper plate guide frame 229 or independently driven from frame 190.

A stripper plate drive motor 248 is attached to cross beam 232 for horizontally displacing stripper plate 200. A sprocket and chain arrangement drives a shaft internal to cross beam 232 which is in turn connected to guide rails 201. The connection from said shaft to stripper plate 200 is done in such a way as to pull stripper plate 200 in either direction horizontally. Pusher bar 204 may be horizontally displaced in a similar fashion. Consequently, the pusher bar drive motor (not shown) would be attached to cross beam 230.

Figure 25:
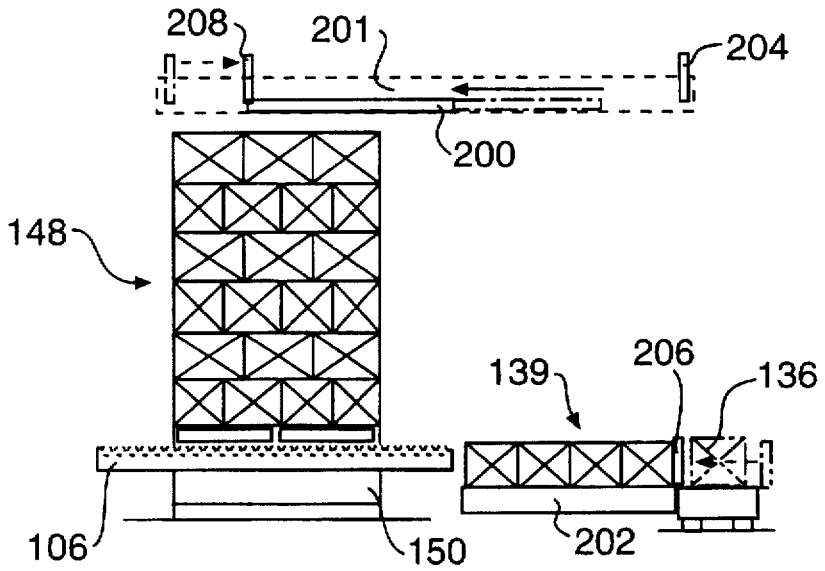
FIGS. 25 to 60 are side views of a third embodiment of a load building and wrapping apparatus according to the present invention, indicating the sequence of operations thereof.
Figure 26:
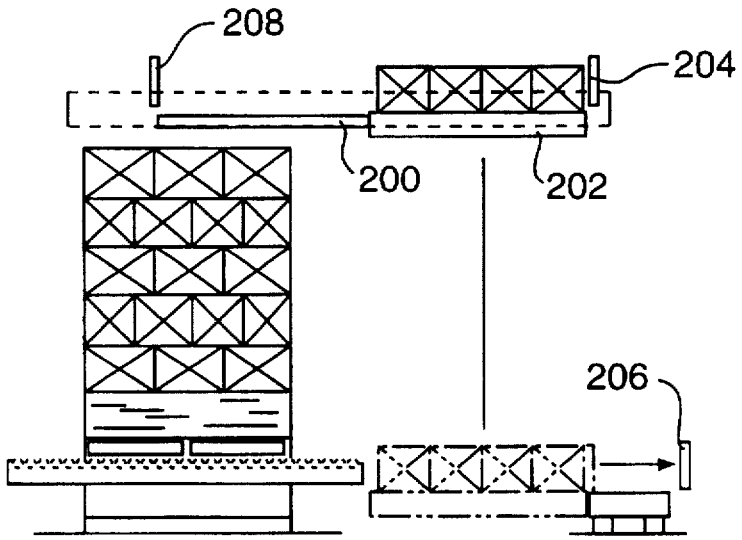

The operation of this embodiment will now be described. First, FIGS. 25–37 depict the sequence of activities performed by the integrated device during the stretch wrapping operation, i.e. while a complete load is being wrapped. As shown in FIG. 25, a load 148 of layers 139 of load units 136 is positioned on pallet 102 and prepared for stretch wrapping. As will be described later, while the final layer 139 of load units 136 was placed on load 148, a layer 139 of load units 136 was prepared on an elevator plate 202. As the stretch wrapping of load 148 begins, elevator plate 202 is displaced vertically to the same vertical position as a stripper plate 200, as shown in FIG. 26.

Figure 27:
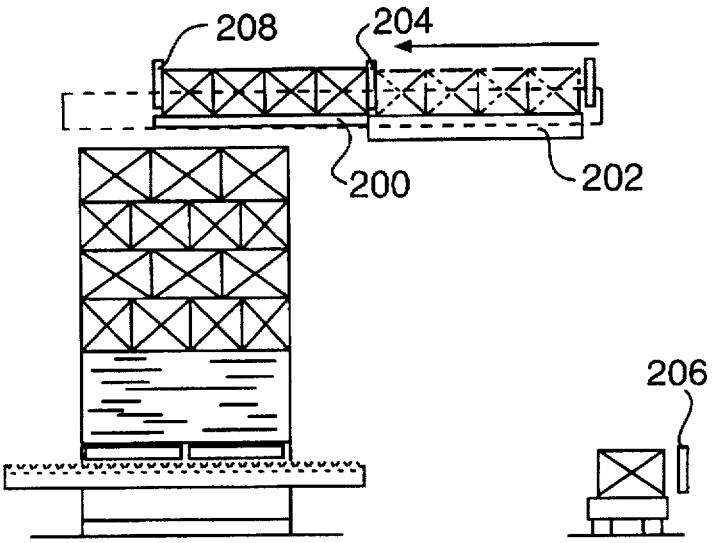
Figure 28:
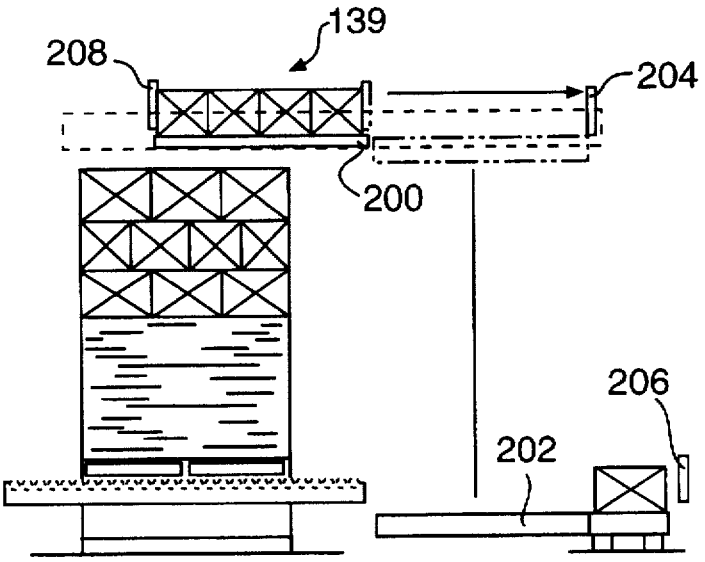
Figure 29:
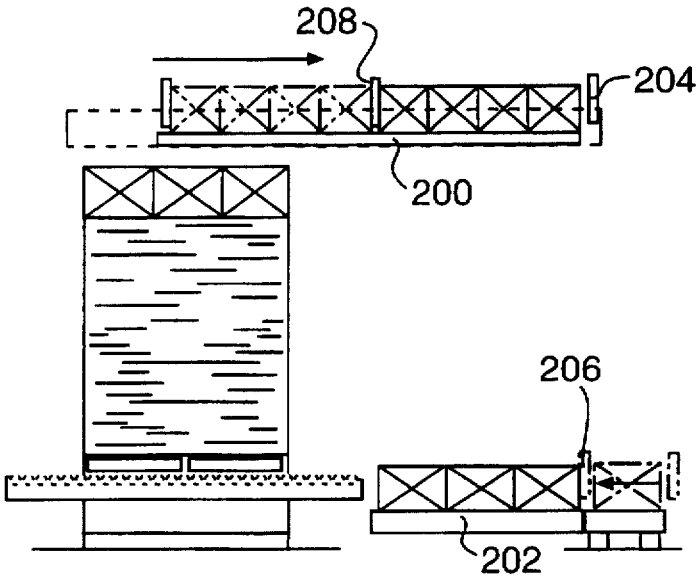
Figure 30:
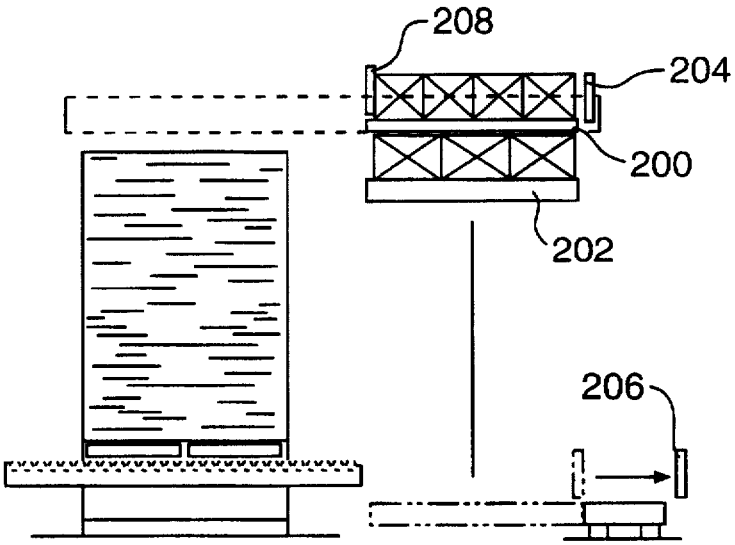
Figure 31:
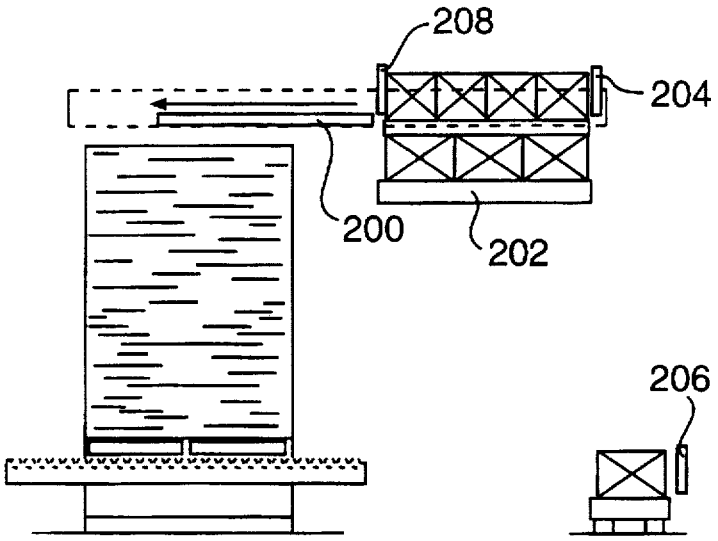
Figure 32:
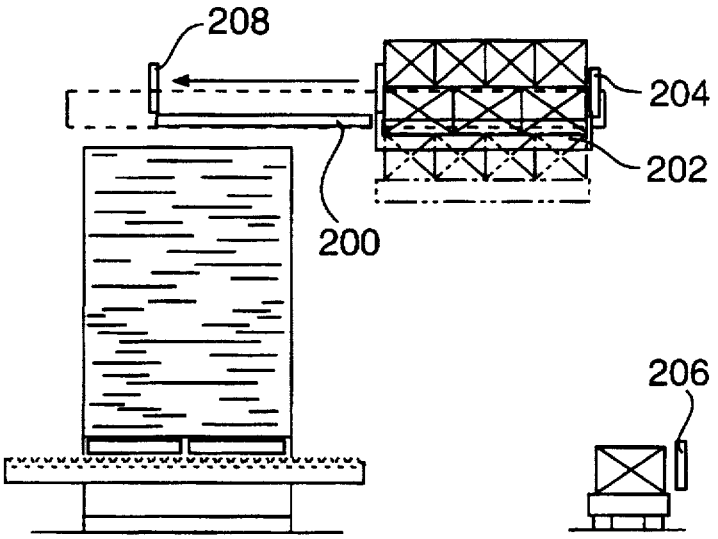
Figure 33:
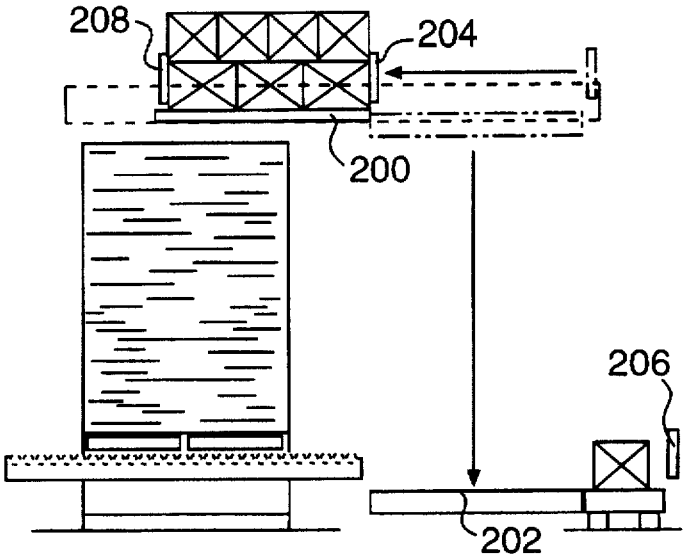
Figure 34:
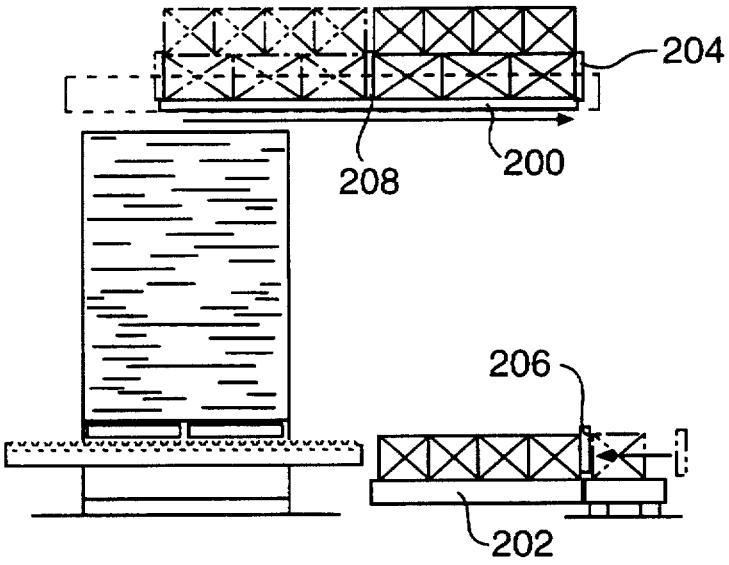
Figure 35:
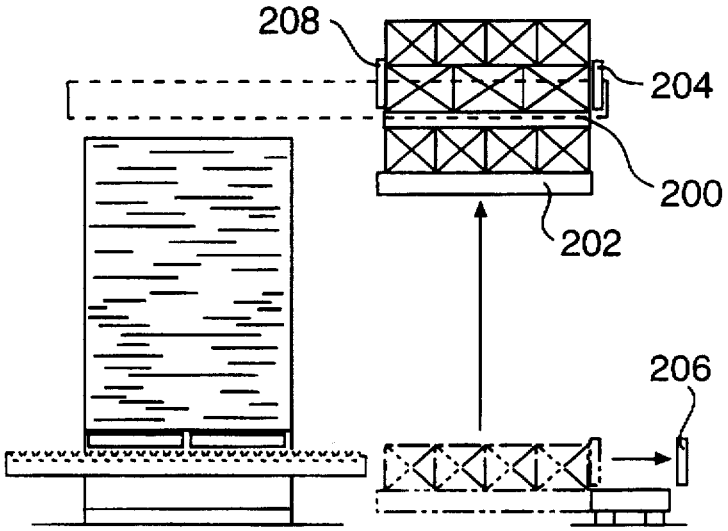
Figure 36:
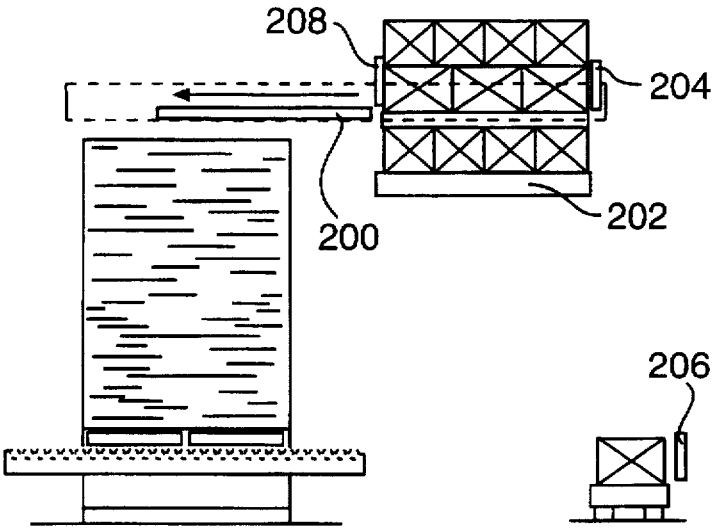
Figure 37:
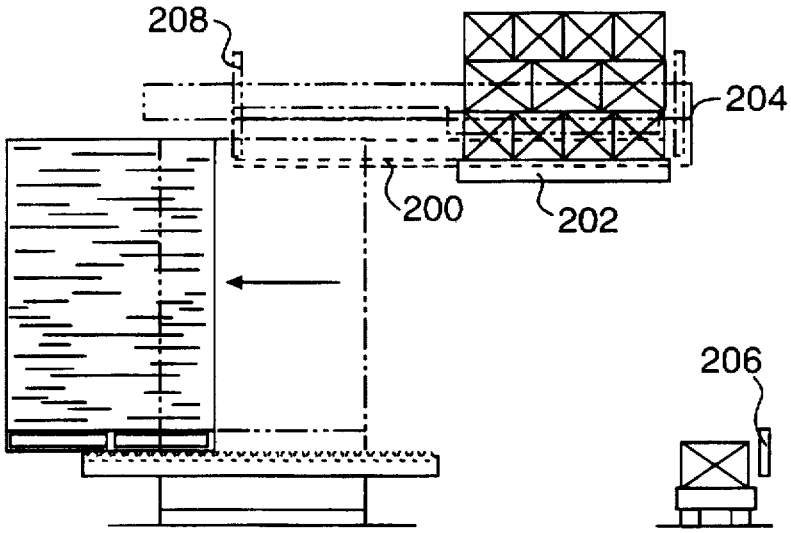

A pusher bar 204 then pushes the completed layer 139 of load units 136 off of elevator plate 202 onto stripper plate 200, as shown in FIG. 27. Next, first pusher bar 204 returns to its original, retracted position and elevator plate 202 lowers to its original position to receive load units 136 incoming from an accumulating conveyor 142. This is shown in FIG. 28. A second pusher bar 206 reciprocates between a retracted position and an extended position to push load units 136 off of accumulating conveyor 142 and onto elevator plate 202. This continues until a complete layer of load units 136 is loaded onto elevator plate 202. At the same time, stripper plate 200 moves horizontally along guide rails 201 to a position above elevator plate 202, as shown in FIG. 29. Additionally, a stripper bar 208 moves into position behind layer 139 of load units 136 on stripper plate 200. After elevator plate 202 receives a complete layer of load units 136, elevator plate 202 is raised, as shown in FIG. 30, to a position just under stripper plate 200. Stripper plate 200 then moves horizontally from a position holding a layer 139 of load units 136 to a position above the load unit 148 being wrapped, as depicted in FIG. 31. Stripper bar 208 prevents layer 139 of load units 136 from moving with stripper plate 200, dropping layer 139 onto the previously assembled layer 139 on elevator plate 202. Elevator plate 202 is then raised to the same vertical position as stripper plate 200, as shown in FIG. 32. First pusher bar 204 then pushes the two layers 139 of load units 136 off of elevator plate 202 and onto stripper plate 200, as shown in FIG. 33. FIGS. 34–36 depict a third layer 139 of load units 136 being loaded onto elevator plate 202 and ultimately combined with the earlier prepared layers 139 of load units 136. At this point, load 148 is completely wrapped and is removed from turntable 106 via conveying rollers 108, as shown in FIG. 37.

It is to be understood that the number of layers that accumulate during the stretch wrapping procedure depends on numerous factors, including the size of the load units 136, the configuration of the load units 136, the height of the load 148, the speed of the infeed of load units 136, the wrapping cycle time (i.e. the amount of time required to wrap a complete load 148), and the palletizer cycle time (i.e. the amount of time required for the mechanical displacement of load units 136). The number of layers accumulated simultaneously to the wrapping process increases significantly when a wrapped load undergoes additional packaging procedures which increase the wrapping cycle time, such as cornerboard placement to protect the corners of the load or add column strength, multiple banding of the wrapped load, covering the top of the load with a top sheet of film, and other packaging procedures that require additional time.

Figure 38:
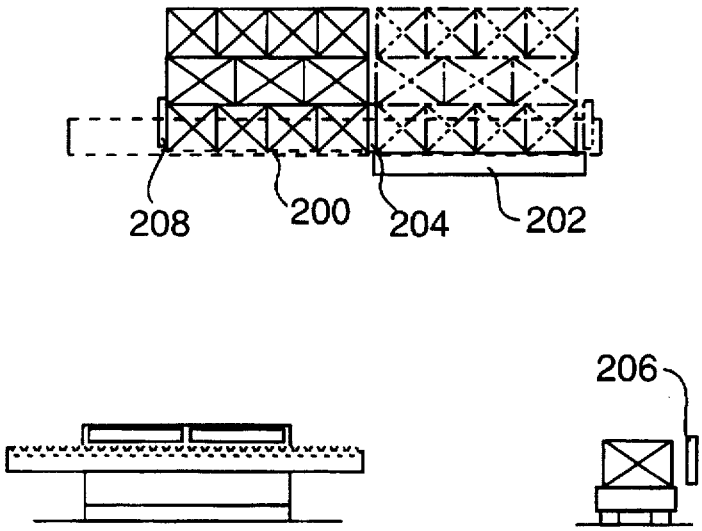
Figure 39:
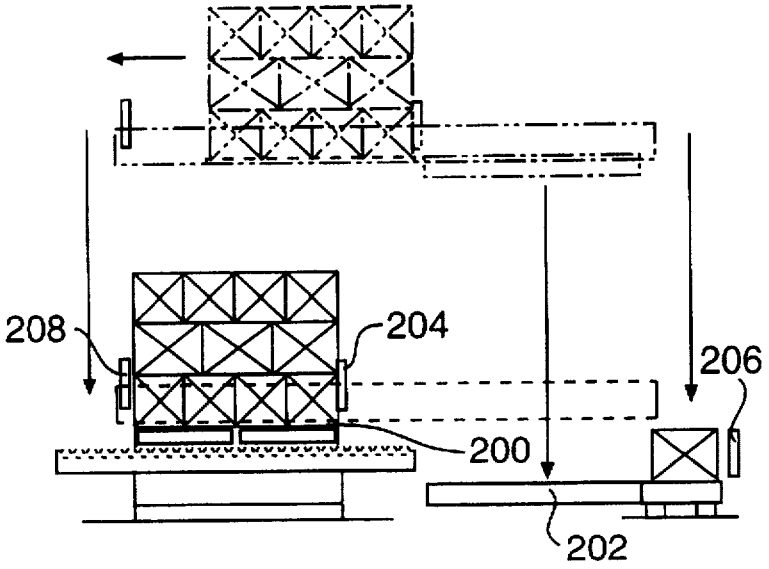
Figure 40:
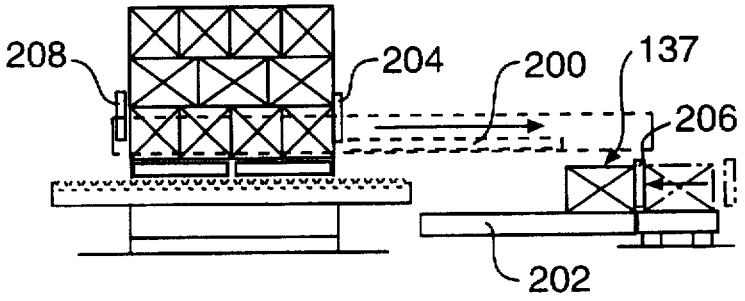
Figure 41:
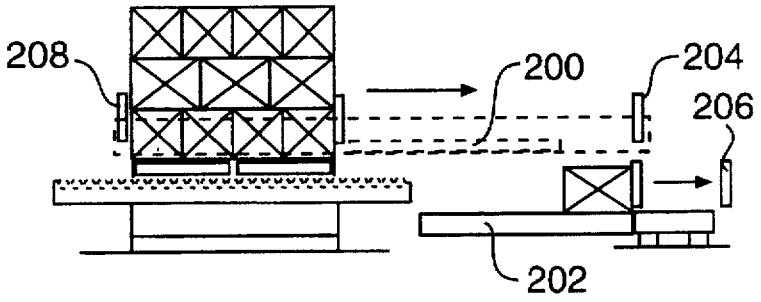
Figure 42:
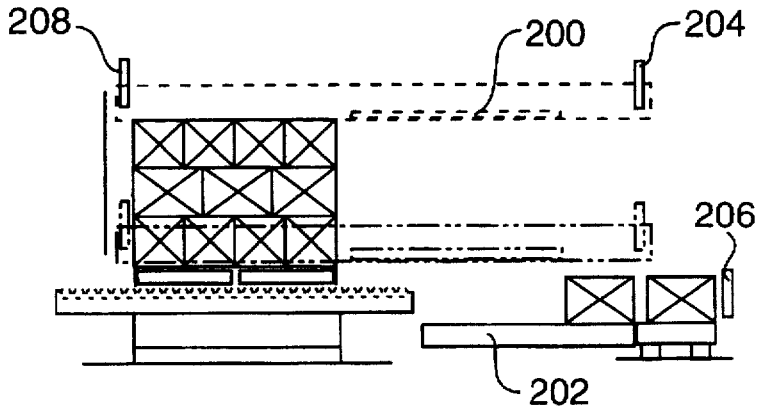
Figure 43:
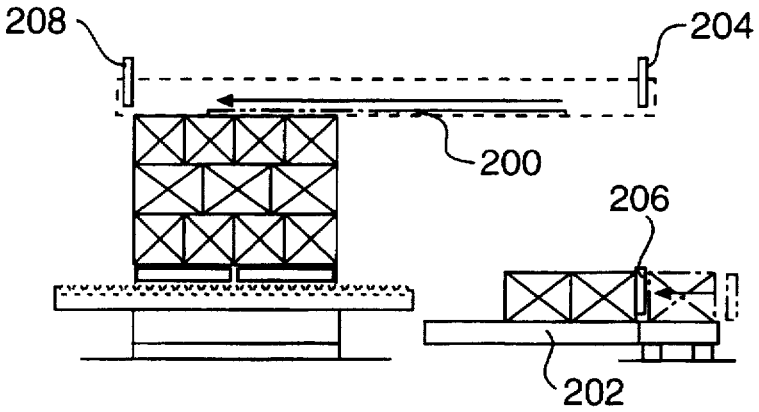
Figure 44:
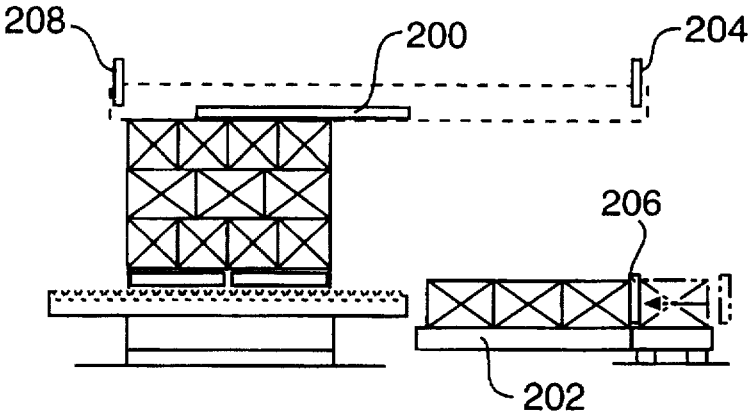

FIGS. 37–60 depict the next sequence of activities performed by the load building and wrapping apparatus to build a complete load 148 prior to stretch wrapping the load. As shown in FIGS. 37 and 38, stripper plate 200 moves downward to the same height as elevator plate 202, and pusher bar 204 pushes the stack of layers 139 of load units 136 from elevator plate 202 to stripper plate 200. As shown in FIG. 39, stripper plate 200 is moved horizontally and vertically to a position just above pallet 102. Simultaneously, elevator plate 202 is moved vertically downward to the position to receive load units 136 from the accumulating conveyor 142. As shown in FIG. 40, the stacked layers 139 of load units 136 are dropped onto pallet 102 by the horizontal movement of stripper plate 200 from a position above pallet 102 to a position above elevator plate 202. First pusher bar 204 acts as a stripping mechanism during the movement of stripper plate 200 by remaining in position behind layer 139 of load units 136. At the same time, as shown in FIG. 40, second pusher bar 206 reciprocates between a retracted position and an extended position to push load units 136 onto elevator plate 202. Thus, the apparatus according to this embodiment accumulates a layer 139 of load units 136 while the layers 139 that were accumulated during the wrapping process are deposited on pallet 102.

Figure 45:
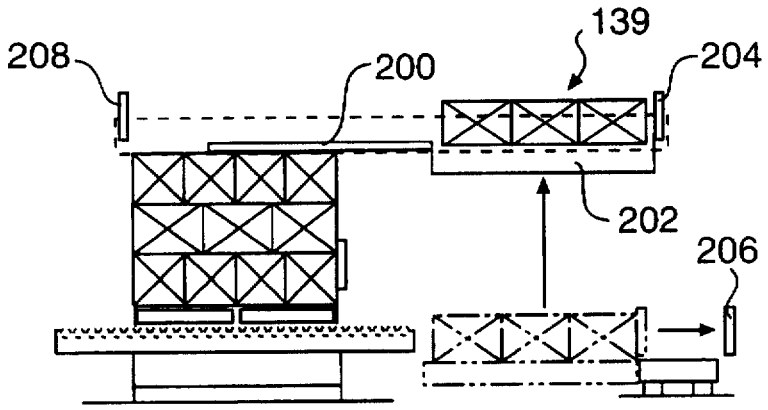
Figure 46:
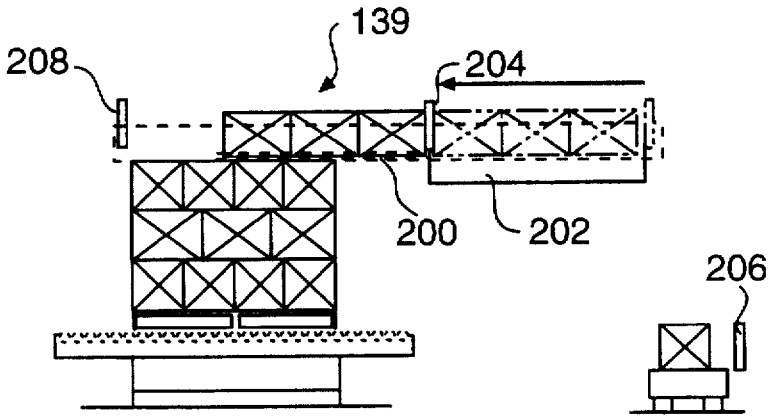
Figure 47:
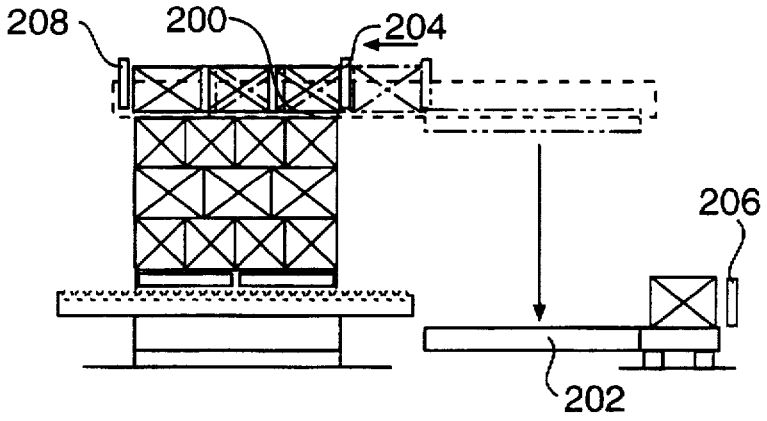
Figure 48:
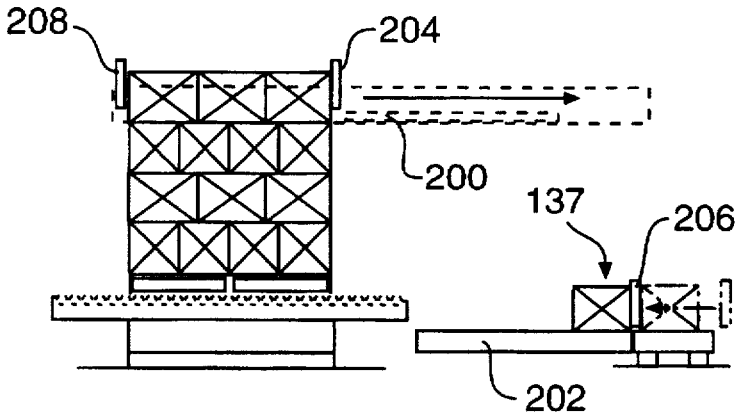
Figure 49:
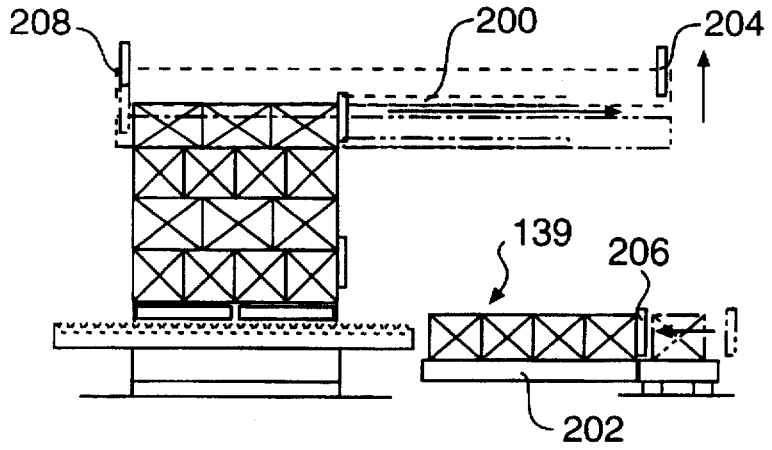
Figure 50:
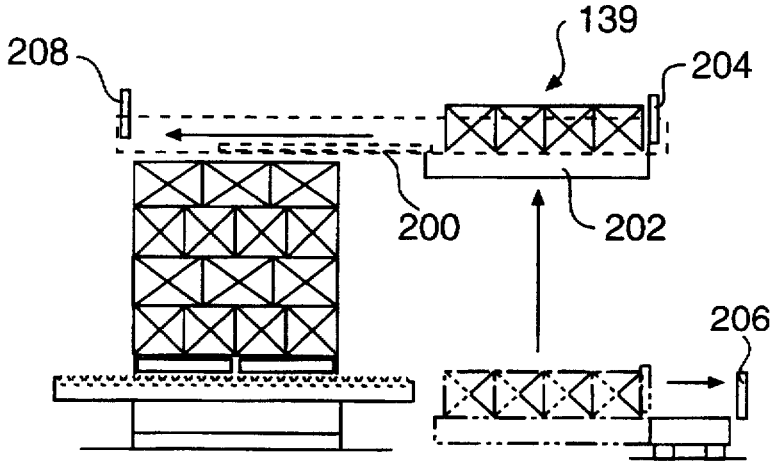
Figure 51:
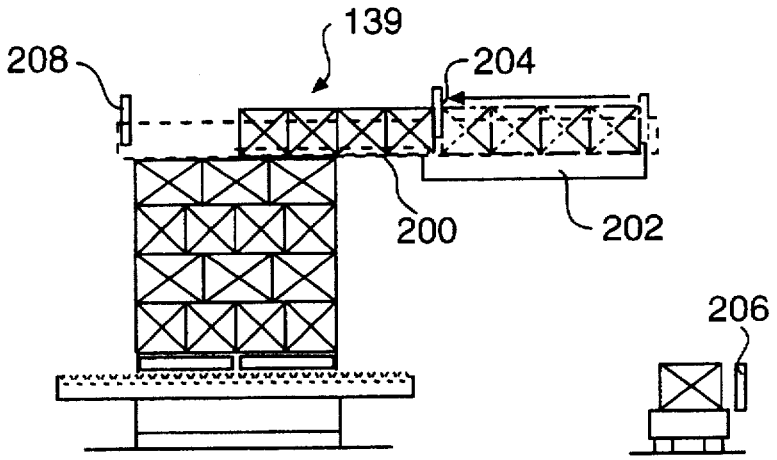
Figure 52:
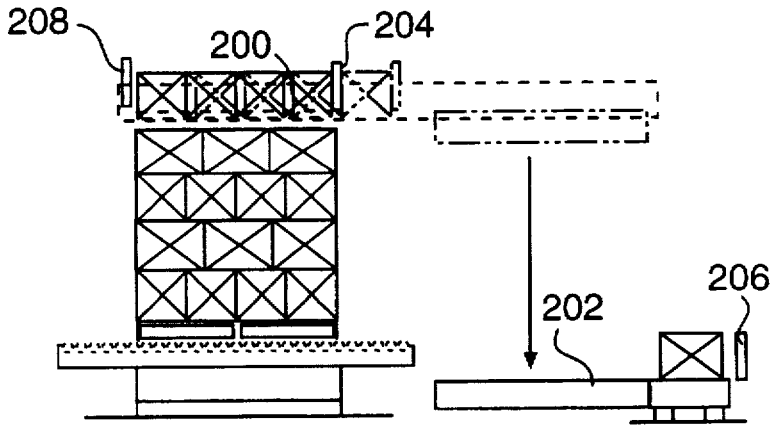
Figure 53:
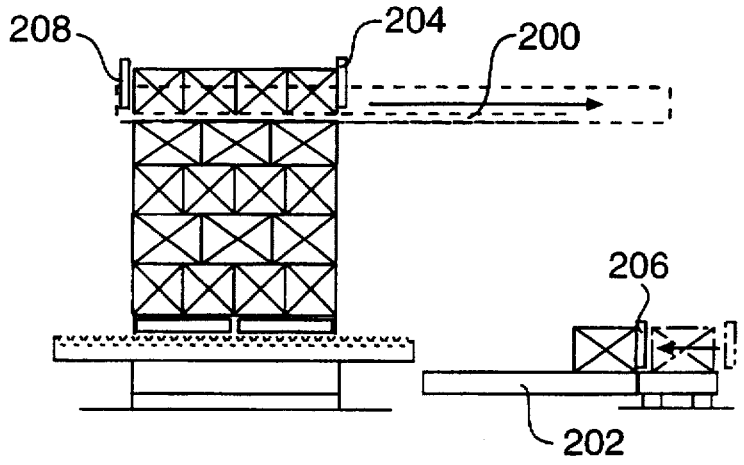
Figure 54:
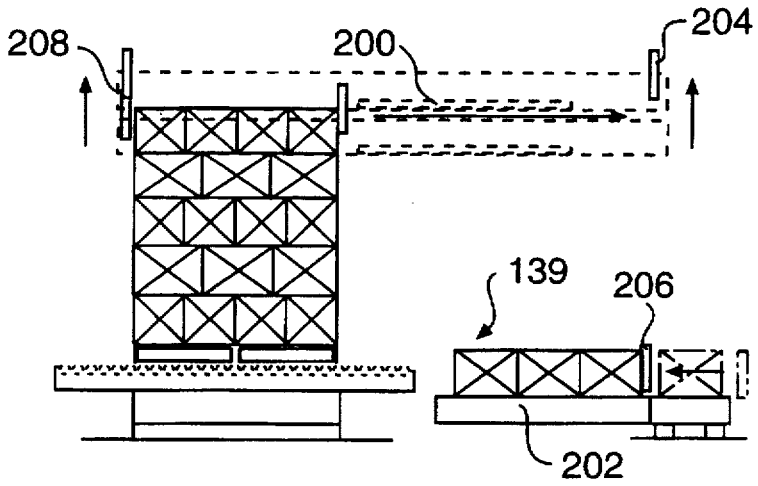
Figure 55:
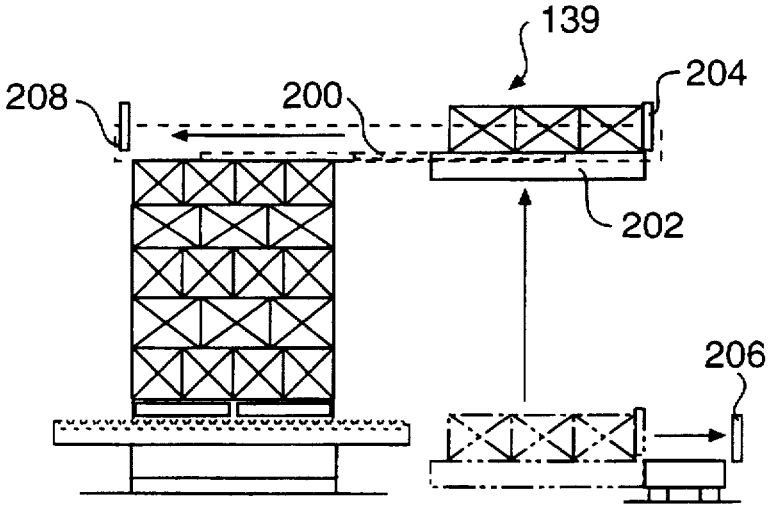
Figure 56:
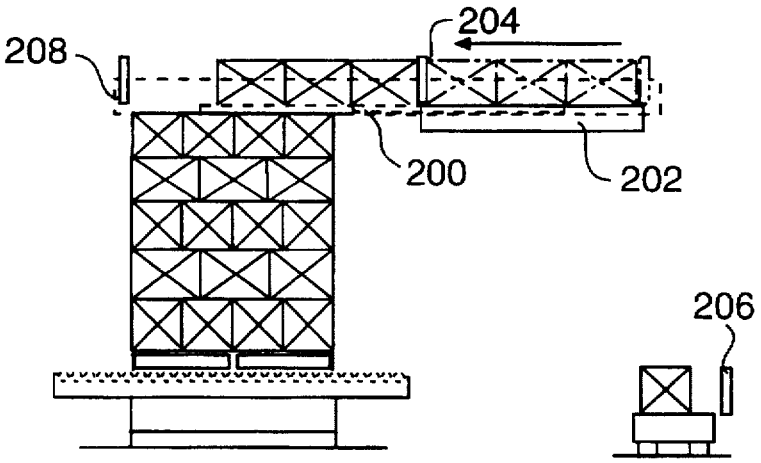
Figure 57:
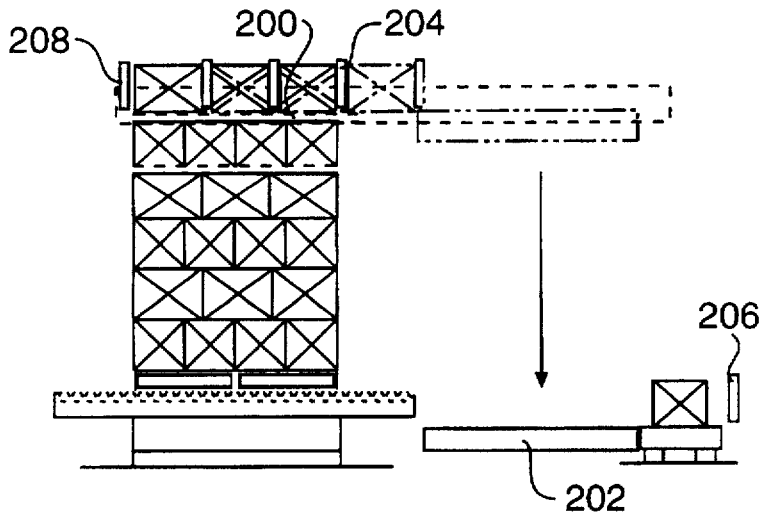

The reciprocating action of second pusher bar 206 continues, as depicted in FIGS. 41–44, until a complete layer 139 of load units 136 has been loaded onto elevator plate 202. During this time, stripper plate 200 is moved vertically to a position just above the three layers 139 of load units 136 on pallet 102. Stripper plate 200 is also moved to a horizontal position so as to abut elevator plate 202 once elevator plate 202 is moved vertically upward, as shown in FIG. 45. First pusher bar 204 then pushes a layer of load units 136 off of elevator plate 202 and onto stripper plate 200, as shown in FIG. 46. Stripper plate 200 is then positioned above the stack of layers 139 of load units 136 on pallet 102, and, at the same time, elevator plate 202 is lowered to a position to receive incoming load units 136 off of the infeed conveyor. This is shown in FIG. 47. As next shown in FIG. 48, stripper plate 200 is moved horizontally from underneath the layer 139 of load units 136 so as to place the layer on top of the stack of layers 139 already on pallet 102. First pusher bar 204 once again acts as a stripping mechanism to strip the layer 139 from stripper plate 200. At the same time, elevator plate 202 is lowered to a position to receive incoming load units 136 of an infeed conveyor. Thus, the apparatus according to this embodiment also accumulates a layer 139 of load units 136 while the stripper plate 200 positions and deposits layer 139 of load units 136.

Figure 58:
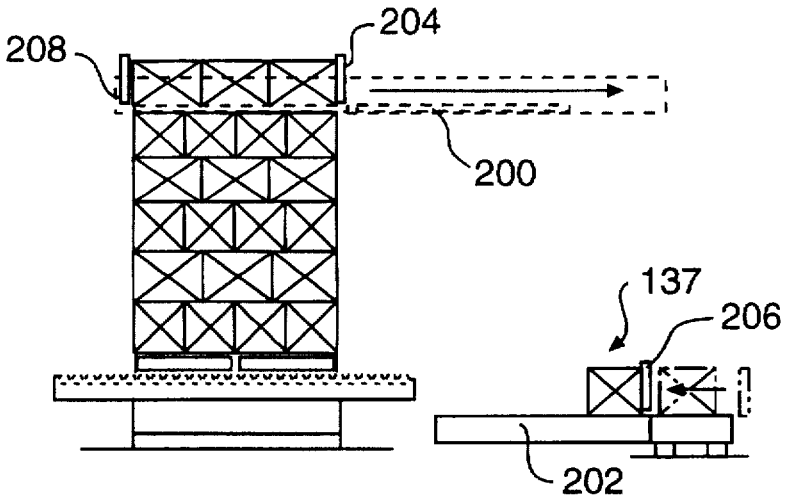
Figure 59:
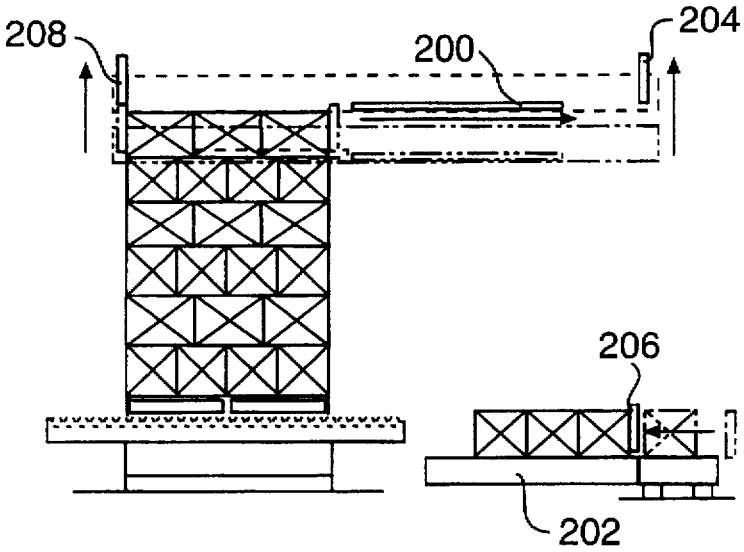
Figure 60:
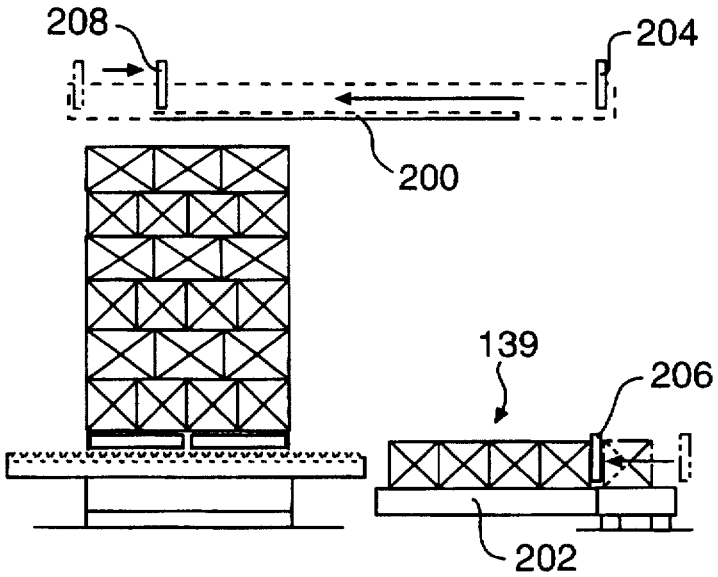

The sequence of procedures just described to add a fourth layer 139 of load units 136 onto pallet 102 is repeated, as shown in FIGS. 49–58, to add subsequent layers 139 until a completed stack of layers 139 of load units 136 has been assembled onto pallet 102, as shown in FIG. 58. While the final layer 139 is placed onto the stack, elevator plate 202 receives a layer of load units 136 from the infeed conveyor, as shown in FIGS. 58–60. After the final layer of load units 136 has been placed onto pallet 102, stripper plate 200 is displaced horizontally and vertically to a position above the completed stack, as shown in FIG. 60. At this point, wrapping of the assembled load 148 begins and the entire stretch wrapping and load building procedure just described repeats beginning with the operation shown in FIG. 25.

As just described, this third embodiment of a load building and wrapping apparatus efficiently builds loads and wraps loads by the coordinated movement and activity of its various components. In particular, the processes of depositing a built layer onto the stacked load and accumulating the next layer overlap in time, reducing the overall cycle time of building and depositing a layer. As shown, for example, in FIG. 47, the time required to position and deposit a built layer onto pallet 102 does not affect the layer building procedure simultaneously occurring on elevator plate 202. In this way, the infeed rate of load units 136 remains constant. In addition, as in the previous embodiments, the stretch wrapping procedure may begin prior to the assembly of a full load by stacking top layers at the same time as wrapping bottom layers.

It will be apparent to those skilled in the art that various modifications and variations can be made in the integrated palletizer and stretch wrapper of the present invention and in construction of the integrated palletizer and stretch wrapper without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

We claim:

1. A method of building and wrapping a load comprising:

infeeding load units to an infeed area of a layer building area at an infeed level below a desired height of the load;

repeatedly building load layers in a layer building area from load units incoming from the infeed area at the infeed level;

repeatedly transporting the load layers from the layer building area to a load building and wrapping area to sequentially build a load of layers to the desired height of the load in the load building and wrapping area from layers built in the layer building area;

wrapping the load of layers in the load building and wrapping area while building at least one interim layer in the layer building area from load units;

outputting the wrapped load from the load building area; and sequentially transporting the interim layer and at least one load layer built in the layer building area from the layer building area to the load building and wrapping area to sequentially form a load of layers in the load building and wrapping area.

2. The method of claim 1 wherein the wrapping step includes rotating the load of layers in the load building and wrapping area.

3. The method of claim 1 wherein the transporting step includes transporting the load layer with a slider plate.

4. The method of claim 2 wherein the transporting step includes transporting the load layer with a slider plate.

5. The method of claim 1 wherein the step of transporting a load layer from the layer building area interferes with and therefore prevents the wrapping of the load in the load building area.

6. The method of claim 1 wherein the step of wrapping includes providing relative rotation between a packaging material dispenser and the load.

7. The method of claim 1 including performing the wrapping step after building the entire load to be wrapped to the desired height of the load.

8. The method of claim 1 including performing the wrapping step after building less than the entire load to be wrapped, and subsequently continuing to build and wrap the load until the load reaches the desired height and is wrapped.

9. The method of claim 1 wherein the step of building a load layer occurs at a position horizontally spaced from the load.

10. A method of building and wrapping a load comprising:

repeatedly building load layers from load units in a layer building area horizontally displaced from a load building and wrapping area;

repeatedly transporting the load layers from the layer building area to the load building and wrapping area to sequentially form a load of layers in the load building and wrapping area from layers built in the layer building area;

wrapping the load of layers in the load building and wrapping area while building at least one interim layer in the layer building area from load units;

supporting the load with a support at a fixed height while building and wrapping the load;

outputting the wrapped load from the load building area; and sequentially transporting the interim layer and at least one load layer built in the layer building area from the layer building area to the load building and wrapping area to sequentially form a load of layers in the load building and wrapping area.

11. An apparatus for building and wrapping a load comprising:

a packaging material dispenser for dispensing packaging material;

means for providing relative rotation between the packaging material dispenser and the load in a load building and wrapping area and wrapping the packaging material around the load;

a layer building palletizer for building a load layer from load units in a layer building area horizontally displaced from the load building and wrapping area; and a layer transporter for transporting the load layer from the layer building area to the load building and wrapping area.

12. The apparatus of claim 11 wherein the means for providing relative rotation includes a turntable for rotating the load in the load building and wrapping area.

13. The apparatus of claim 11 wherein the layer building palletizer includes a fixed height support for building load layers at a fixed height location.

14. The apparatus of claim 11 including a fixed height load support for wrapping the load at a fixed height location.

15. The apparatus of claim 11 wherein the layer transporter includes a stripper plate.

16. The apparatus of claim 11 wherein the layer transporter includes a stripper plate movable between the layer building area and the load building and wrapping area, the stripper plate having a layer transporting area for supporting a complete layer.

17. An apparatus for building and wrapping a load comprising:

a packaging material dispenser for dispensing packaging material;

means for providing relative rotation between the packaging material dispenser and the load in a load building and wrapping area and wrapping the packaging material around the load;

a layer building palletizer for building a load layer in a layer building area from load units incoming at a position below a desired height of the load; and a layer transporter for transporting the load layer from the layer building area to the load building and wrapping area.

18. A method of building and stretch wrapping loads of layers of load units, the method comprising:

repeatedly building a layer of load units of a first load onto a first plate of a palletizer and depositing the layer of load units onto a stretch wrapping apparatus until the first load of layers is built to a desired height;

rotating the first load relative to a web dispenser that dispenses and stretches a web to wrap the web around the first load; and building a layer of load units of a second load on a second plate of the palletizer while the first load is being wrapped.

19. The method of claim 18, further comprising:

removing the first load after the first load is fully wrapped;

depositing the layer of load units of the second load onto the stretch wrapping apparatus; and repeatedly building a layer of load units of the second load onto the first plate and depositing the layer of load units onto the stretch wrapping apparatus until the second load of layers is built to a desired height.

20. A method of building and stretch wrapping loads of layers of load units, the method comprising:

rotating a first load of load units on a stretch wrapping apparatus relative to a web dispenser that dispenses and stretches a web to wrap the web around the first load;

repeatedly building a layer of load units of a second load onto a first plate of a palletizer and depositing the layer of load units onto a second plate of the palletizer to form a stack of layers of the second load while the first load is being wrapped and until the first load is fully wrapped;

removing the wrapped first load from the stretch wrapping apparatus; and depositing the stack of layers of the second load onto the stretch wrapping apparatus.

* * * * *